US010627177B2

(12) United States Patent
Hamilton

(10) Patent No.: US 10,627,177 B2
(45) Date of Patent: Apr. 21, 2020

(54) BOLT ACTION UPPER RECEIVER FOR AR RIFLE

(71) Applicant: UINTAH PRECISION LLC, Duchesne, UT (US)

(72) Inventor: Richard Hamilton, Duchesne, UT (US)

(73) Assignee: Uintah Precision LLC, Duchesne, UT (US)

( * ) Notice: Subject to any disclaimer, the term of this patent is extended or adjusted under 35 U.S.C. 154(b) by 238 days.

(21) Appl. No.: 15/666,230

(22) Filed: Aug. 1, 2017

(65) Prior Publication Data

US 2018/0045476 A1 Feb. 15, 2018

Related U.S. Application Data

(60) Provisional application No. 62/373,499, filed on Aug. 11, 2016.

(51) Int. Cl.

| | |
|---|---|
| ***F41A 3/66*** | (2006.01) |
| ***F41A 3/22*** | (2006.01) |
| ***F41A 9/59*** | (2006.01) |
| ***F41A 15/14*** | (2006.01) |
| ***F41A 9/41*** | (2006.01) |

(52) U.S. Cl.

CPC ..... *F41A 3/66* (2013.01); *F41A 3/22* (2013.01); *F41A 9/41* (2013.01); *F41A 9/59* (2013.01); *F41A 15/14* (2013.01)

(58) Field of Classification Search

CPC ..... F41A 3/66; F41A 3/22; F41A 9/41; F41A 9/59; F41A 15/14; F41A 19/43; F41A 19/30

USPC ..... 42/18

See application file for complete search history.

(56) References Cited

U.S. PATENT DOCUMENTS

| | | | | |
|---|---|---|---|---|
| 4,515,064 | A * | 5/1985 | Hohrein | F41A 11/02 42/49.02 |
| 9,038,303 | B1 * | 5/2015 | Olson | F41A 3/16 42/25 |
| 9,234,713 | B1 * | 1/2016 | Olson | F41A 15/14 |
| 9,885,528 | B2 | 2/2018 | Mather | |
| 10,458,731 | B2 | 10/2019 | Mather | |
| 2011/0061523 | A1 * | 3/2011 | Webb | F41A 3/42 89/128 |
| 2013/0269510 | A1 * | 10/2013 | Sullivan | F41A 5/28 89/193 |
| 2014/0075806 | A1 * | 3/2014 | Blank | F41A 3/26 42/25 |
| 2014/0075807 | A1 * | 3/2014 | Lewis | F41A 15/14 42/25 |

(Continued)

*Primary Examiner* — Joshua E Freeman
*Assistant Examiner* — Bridget A Cochran
(74) *Attorney, Agent, or Firm* — Maschoff Brennan; Jonathan M. Benns

(57) ABSTRACT

A bolt action AR rifle can be prepared using a standard AR lower assembly and coupling it to a bolt action upper assembly. The bolt action upper assembly has a bolt action receiver containing a bolt. The method of forming a bolt action AR rifle can include: providing the bolt action upper receiver assembly; providing the standard AR lower AR receiver assembly having a pivot pin and takedown pin; inserting the pivot pin into the pivot pin receiver hole; pivoting the bolt action upper receiver assembly at the pivot pin until the takedown pin is aligned with the takedown pin receiver hole; and inserting the takedown pin into the takedown pin receiver hole.

20 Claims, 19 Drawing Sheets

(56) References Cited

U.S. PATENT DOCUMENTS

| | | | | |
|---|---|---|---|---|
| 2015/0198394 | A1* | 7/2015 | Hochstrate | F41A 3/26 42/17 |
| 2015/0233656 | A1* | 8/2015 | Karagias | F41C 23/04 42/16 |
| 2016/0238334 | A1* | 8/2016 | Pflaumer | F41A 35/06 |
| 2016/0252314 | A1* | 9/2016 | Mather | F41A 3/30 42/16 |
| 2016/0348990 | A1* | 12/2016 | Steil | F41A 5/18 |
| 2017/0198999 | A1* | 7/2017 | Goddard | F41A 15/16 |
| 2018/0112939 | A1* | 4/2018 | Wheatley | F41A 3/72 |

* cited by examiner

BOLT ACTION UPPER RECEIVER FOR AR RIFLE

CROSS-REFERENCE

This patent application claims priority to U.S. Provisional Application No. 62/373,499 filed Aug. 11, 2016, which provisional is incorporated herein by specific reference in its entirety.

BACKGROUND

Often, rifle sportsmen enjoy shooting guns of different types and different calibers. However, one gun is often of a single type and of a single caliber. As such, the rifle sportsman has to obtain multiple guns in order to have different types and/or different calibers. While it may be favorable to have different types of guns, the rifle sportsman is forced into buying multiple guns.

Therefore, it would be advantageous to be able to have a gun that converts from a first type to a second type.

SUMMARY

In one embodiment, a bolt can be configured for being included in a bolt action upper receiver of a bolt action upper receiver assembly. The bolt action upper receiver assembly can be configured to be coupled to a standard AR lower receiver assembly. The bolt can include a unitary body having: a bolt head having three bolt lungs extending outward relative to three bolt reliefs that are located between the bolt lungs, wherein one bolt lug includes an extractor slot extending radially from a bolt head recess all the way through the one bolt lug. The unitary bolt body can be elongate and having: a bullet pushing ridge extending from a bolt neck to a bolt end opposite of the bolt head, the bullet pushing ridge having a height and length relative to the bolt body; a bullet pushing slope extending downward from the bullet pushing ridge toward the bolt end and terminating at a hammer pushing ridge; the hammer pushing ridge extending from the bullet pushing slope to an end slot; an end ramp across the end slot from the hammer pushing ridge, the end ramp extending upward; an end ridge extending from a top of the end ramp; and a firing pin recess at the bolt end extending toward the bolt head, wherein the firing pin recess includes an opening from the bolt end around the end ramp and end ridge so as to be open with the end slot, wherein the bolt neck is connecting the bolt head with the bolt body, the bolt neck being thinner than the bolt body. In one aspect, the bullet pushing ridge, bullet pushing slope, hammer pushing ridge, end slot, end ramp and end ridge are longitudinally aligned with one of the bolt lugs. In one aspect, the unitary body has a first body portion of the bolt body extending from the bolt neck toward the bolt end and terminating at a magazine recess that has a shape commensurate with a magazine with a second body portion extending from the magazine recess to the bolt end. In one aspect, the first body portion, magazine recess and second body portion are longitudinally aligned. In one aspect, the first body portion, magazine recess and second body portion are longitudinally aligned with the one bolt lung that has the extractor slot, and wherein the second body portion is separated from the end ridge by the firing pin recess. In one aspect, the unitary body has a bolt handle recess in the second body portion offset from the magazine recess, the bolt handle recess extending into the firing pin recess. In one aspect, the first body portion and second body portion are portions of a cylindrical portion of the unitary body, which cylindrical portion extends from a first side of a base of the bullet pushing ridge and first side of a base of the end ridge around to a second side of the base of the bullet pushing ridge and second side of the base of the end ridge. In one aspect, the cylindrical portion includes a roll pin hole and a nut relief. In one aspect, the hammer pushing ridge has a higher elevation than the end ridge.

In one embodiment, a bolt action upper receiver can be configured to be coupled with a standard AR lower receiver. The bolt action upper receiver can include a unitary receiver body having a receiver lumen and a top; a proximal end having a bolt opening; a distal end having a barrel opening surrounded by a threaded receiver with a dowel pin receiver in a distal end of the threaded receiver, the dowel pin receiver being axially oriented; a bottom comprising: a magazine slot open to and longitudinally aligned with a hammer slot, the hammer slot being narrower than the magazine slot; a takedown pin receiver hole at a proximal end, the takedown pin receiver hole being orthogonal with the magazine slot and hammer slot; and a pivot pin receiver hole at a distal end, the pivot pin receiver hole being orthogonal with the magazine slot and hammer slot, the pivot pin receiver hole being parallel with the takedown pin receiver hole; a first side having: a bolt handle slot extending from the bolt opening and exposing a portion of the receiver lumen; a bolt rest slot extending from the bolt handle slot; an ejection port between the bolt handle slot and distal end; and a second side having a magazine release receiver recess. In one aspect, the bolt action upper receiver can include an extractor ramp that defines an end of the bolt handle slot that intersects with the bolt rest slot. In one aspect, the bolt action upper receiver can include a picatinny rail on the top. In one aspect, the bolt action upper receiver can include the bottom comprising a pivot pin body having the pivot pin receiver hole and a takedown pin body having the takedown pin receiver hole.

In one embodiment, a bolt action upper receiver assembly can include: a bolt action upper receiver configured to be coupled with a standard AR lower receiver, the bolt action upper receiver comprising a unitary receiver body having a receiver lumen, the unitary receiver body having: a top; a proximal end having a bolt opening; a distal end having a barrel opening surrounded by a threaded receiver with a dowel pin receiver in a distal end of the threaded receiver, the dowel pin receiver being axially oriented; a bottom comprising: a magazine slot open to and longitudinally aligned with a hammer slot, the hammer slot being narrower than the magazine slot; a takedown pin receiver hole at a proximal end, the takedown pin receiver hole being orthogonal with the magazine slot and hammer slot; and a pivot pin receiver hole at a distal end, the pivot pin receiver hole being orthogonal with the magazine slot and hammer slot, the pivot pin receiver hole being parallel with the takedown pin receiver hole; a first side having: a bolt handle slot extending from the bolt opening and exposing a portion of the receiver lumen; a bolt rest slot extending from the bolt handle slot; and an ejection port between the bolt handle slot and distal end; a second side having a magazine release receiver recess; and a bolt slidably located in the receiver lumen, the bolt comprising a unitary body having: a bolt head having three bolt lungs extending outward relative to three bolt reliefs that are located between the bolt lungs, wherein one bolt lug includes an extractor slot extending radially from a bolt head recess all the way through the one bolt lug; a bolt body being elongate and having: a bullet pushing ridge extending from a bolt neck to a bolt end opposite of the bolt head, the bullet pushing ridge having a height and length relative to the bolt body; a bullet pushing slope extending downward from the bullet pushing ridge toward the bolt end and terminating at a hammer pushing ridge; the hammer pushing ridge extending from the bullet pushing slope to an end slot; an end ramp across the end slot from the hammer pushing ridge, the end ramp extending upward; and an end ridge extending from a top of the end ramp; and a firing pin recess at the bolt end extending toward the bolt head, wherein the firing pin recess includes an opening from the bolt end around the end ramp and end ridge so as to be open with the end slot, wherein the bolt neck is connecting the bolt head with the bolt body, the bolt neck being thinner than the bolt body. In one aspect, the bullet pushing ridge, bullet pushing slope, hammer pushing ridge, end slot, end ramp and end ridge are longitudinally aligned with one of the bolt lugs, and which are oriented toward the bottom of the bolt action upper receiver in a firing orientation. In one aspect, the unitary body having a first body portion of the bolt body extending from the bolt neck toward the bolt end and terminating at a magazine recess that has a shape commensurate with a magazine with a second body portion extending from the magazine recess to the bolt end, wherein the first body portion, magazine recess and second body portion are longitudinally aligned, wherein the magazine recess is oriented toward the bottom of the bolt action upper receiver in a loading orientation. In one aspect, the unitary body having a bolt handle recess in the second body portion offset from the magazine recess, the bolt handle recess extending into the firing pin recess, a bolt handle located in the bolt handle recess, the bolt handle: extending out of the bolt handle slot during the loading orientation; and extending out of the bolt rest slot during the firing orientation. In one aspect, the bolt action upper receiver comprising an extractor ramp that defines an end of the bolt handle slot that intersects with the bolt rest slot. In one aspect, the bolt action upper receiver comprising a picatinny rail on the top.

In one embodiment, a method of forming a bolt action AR rifle can include: providing the bolt action upper receiver assembly of one of the embodiments; providing a standard AR lower receiver assembly having a pivot pin and takedown pin; inserting the pivot pin into the pivot pin receiver hole; pivoting the bolt action upper receiver assembly at the pivot pin until the takedown pin is aligned with the takedown pin receiver hole; and inserting the takedown pin into the takedown pin receiver hole.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
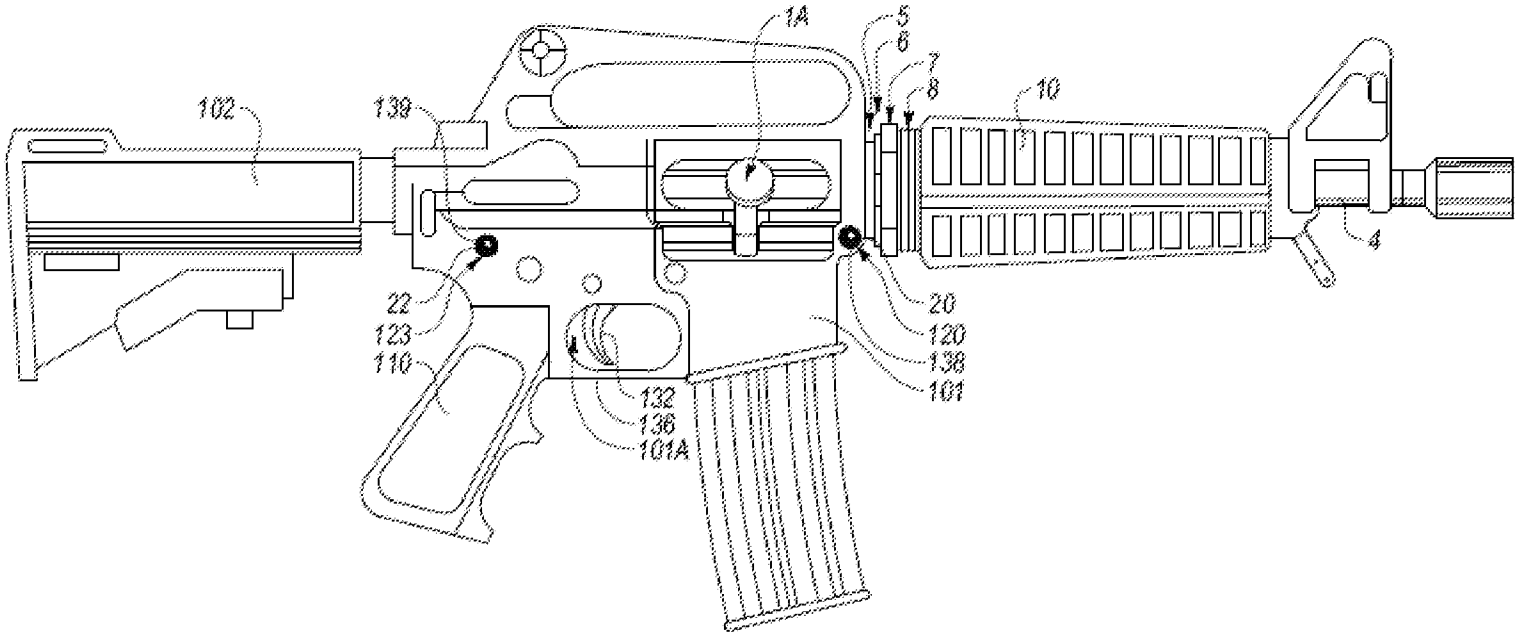
FIG. 1 (Prior Art)
FIG. 1 illustrates a side view of an AR rifle.

The components of the figures are arranged in accordance with at least one of the embodiments described herein, and which arrangement may be modified in accordance with the disclosure provided herein by one of ordinary skill in the art.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Generally, the present invention relates to an AR rifle, such as an AR-10 and/or AR-15 or other configured and modifiable rifle as described herein. Particularly, the invention relates to a DPMS LR-308 pattern for an upper assembly and lower assembly of an AR rifle; however, it should be recognized that any appropriately configured rifle (e.g., Armalite AR-10 pattern) that can have the upper assembly separable from the lower assembly in the manner described herein may be combined with the bolt action upper assembly of the present invention. Now, with the present invention that includes a bolt action upper assembly that can be fit onto and coupled with a lower assembly (e.g., unmodified lower assembly, such as a DPMS LR-308 pattern, or Armalite AR-10 pattern), an AR rifle may be converted to a bolt action rifle by merely replacing any upper assembly or standard semi-automatic upper assembly with the bolt action upper assembly as described herein. As such, reference herein to AR rifles applies equally to the AR-10 and/or AR-15 or other similar rifles. One of skill in the art can use the teachings related to the AR-10 bolt action upper assembly provided herein in order to prepare an AR-15 bolt action upper assembly or any other AR rifle having the same. While the application teaches the DPMS LR-308 pattern, the teachings are also for an Armalite AR-10 pattern.

As used herein, the "AR" is intended to mean a rifle of the type of AR platform rifles (e.g., ArmaLite rifle) that are commonly known, which are "assault rifle" type and may be "automatic rifle" type or "semi-automatic rifle type. Otherwise, the AR is as defined herein. Also, it should be understood that the AR may be of any manufacturer that makes an AR rifle as known and understood by one of ordinary skill in the art. It is well known that an AR rifle is a specific platform and type of rifle.

By way of example and background, a standard semi-automatic AR rifle is shown in FIG. 1. In some instances, features of the standard semi-automatic AR rifle can be included in the bolt action upper assembly, such as the barrel, barrel nut, and other aspects of mounting the barrel to the upper assembly. Also, the firing pin of a standard semi-automatic upper assembly may be utilized in the bolt action upper assembly. The present invention provides a bolt action upper assembly that mounts to a standard AR rifle lower assembly as described herein. In fact, the bolt action upper assembly is configured to be self-contained and attachable to the lower assembly by using the takedown pin (e.g., rear pin) and pivot pin (e.g., front pin). For example, removing the takedown pin and pivot pin from a standard semi-automatic AR rifle allows the standard semi-automatic upper assembly to be removed from the standard lower assembly, and then the bolt action upper assembly can be mounted onto the standard lower assembly with the takedown pin and pivot pin replaced in order to arrive at the fully functional bolt action AR rifle.

FIG. 1 shows an assembled AR-10. FIG. 1 shows the semi-automatic upper assembly 1 mounted to the standard lower assembly 101A via the takedown pin 123 and pivot pin 120 being received through the proper holes in the upper assembly 1A and lower assembly 101A, such as described herein.

A standard automatic or semi-automatic AR-10 upper assembly 1A often includes an upper receiver, charging handle assembly, bolt carrier assembly, barrel tube, slip ring retaining ring, slip ring spring assembly, barrel nut, slip ring, gas tube, handguard, handguard cap, picatinny gas block, picatinny housing clamp screw, gas tube pin, spiral pin, front sling swivel, crush washer, and flash suppressor. An upper pivot pin receiver hole 20 (e.g., for receiving the pivot pin 120) and an upper takedown pin receiver hole 22 (e.g., for receiving the takedown pin 123) are shown to receive pins (e.g., pivot pin 120 and takedown pin 123) from the lower assembly 101A in order to form the full AR-10. Due to the pivot pin 120 and takedown pin 123 being installed in the upper pivot pin receiver hole 20 and upper takedown pin receiver hole 22, respectively, the upper pivot pin receiver hole 20 and upper takedown pin receiver hole 22 are not clearly seen; however, they are shown in other figures provided herein.

It should be noted that the barrel tube 4, slip ring retaining ring 5, slip ring spring assembly 6, barrel nut 7, and slip ring 8, can, in some embodiments, be used to mount the barrel to the inventive bolt action upper assembly as described herein; however, some embodiments may omit these components. The hand guard 10 may also be used with the bolt action upper assembly. In other embodiments, an AR free float fore end is included in the inventive bolt action upper assembly as described herein. In one embodiment, a fore end having a gas block is excluded from the present invention.

An assembled bolt action AR having the bolt action upper assembly mounted to a lower assembly 101A may be provided in an embodiment. The lower assembly 101A can include the lower receiver 101, buttstock assembly 102, receiver extension tube, operating spring 104 (FIG. 3B), buffer 105, buttstock spacer, buttstock screw, buffer detent, pistol grip 110, pistol grip screw, pistol grip washer, bolt stop, bolt stop pin, bolt stop plunger, bolt stop spring, magazine catch, magazine catch button, magazine catch spring, pivot pin 120, detent pin, detent spring, takedown pin 123, safety selector, safety spring, safety detent, trigger pin, two stage tactical hammer, D-ring, hammer torsion spring, trigger spring, two stage trigger 132, coiled spring pin, two stage disconnector, disconnector spring, trigger guard assembly 136, and trigger guard pin. Pivot pin receiver hole 138 is shown to receive the pivot pin 120 (e.g., difficult to see due to the pivot pin 120 being therein) and takedown pin receiver hole 139 is shown to receive the takedown pin 123 (e.g., difficult to see due to the takedown pin 123 being therein). The entirety of the lower receiver 101 and/or lower assembly 101A may be used for the bolt action AR rifle described herein, where the entirety of the lower receiver assembly 101A may be mounted to the bolt action upper receiver assembly.

To mount the upper assembly 1A with the lower assembly 101A, the upper pivot pin receiver hole 20 is aligned with the lower pivot pin receiver hole 138 with the pivot pin 120 being received therethrough, and the upper takedown pin receiver hole 22 is aligned with the lower takedown pin receiver hole 139 with the takedown pin 123 received therethrough. Pulling out the takedown pin 123 and pivot pin 120 allows disassembly, and replacement of the takedown pin 123 and pivot pin 120 allows assembly.

The AR-10 can include a bolt carrier assembly having the firing pin retaining pin, firing pin, firing pin spring, cam pin, bold carrier, key screws, bold carrier key, and bolt assembly as separate parts. Here, the firing pin, and firing pin spring can be used with the bolt of the bolt action upper assembly.

The AR-10 can include a bolt assembly having the gas ring, bolt, extractor spring insert, extractor spring, o-ring, extractor, extractor pin, ejector pin, ejector spring, and ejector. Here, the extractor spring insert, extractor spring, and extractor can be used in the bolt action bolt assembly described herein. Also, the ejector spring and ejector may also be used for brass ejection with the bolt action bolt assembly.

Figure 2A:
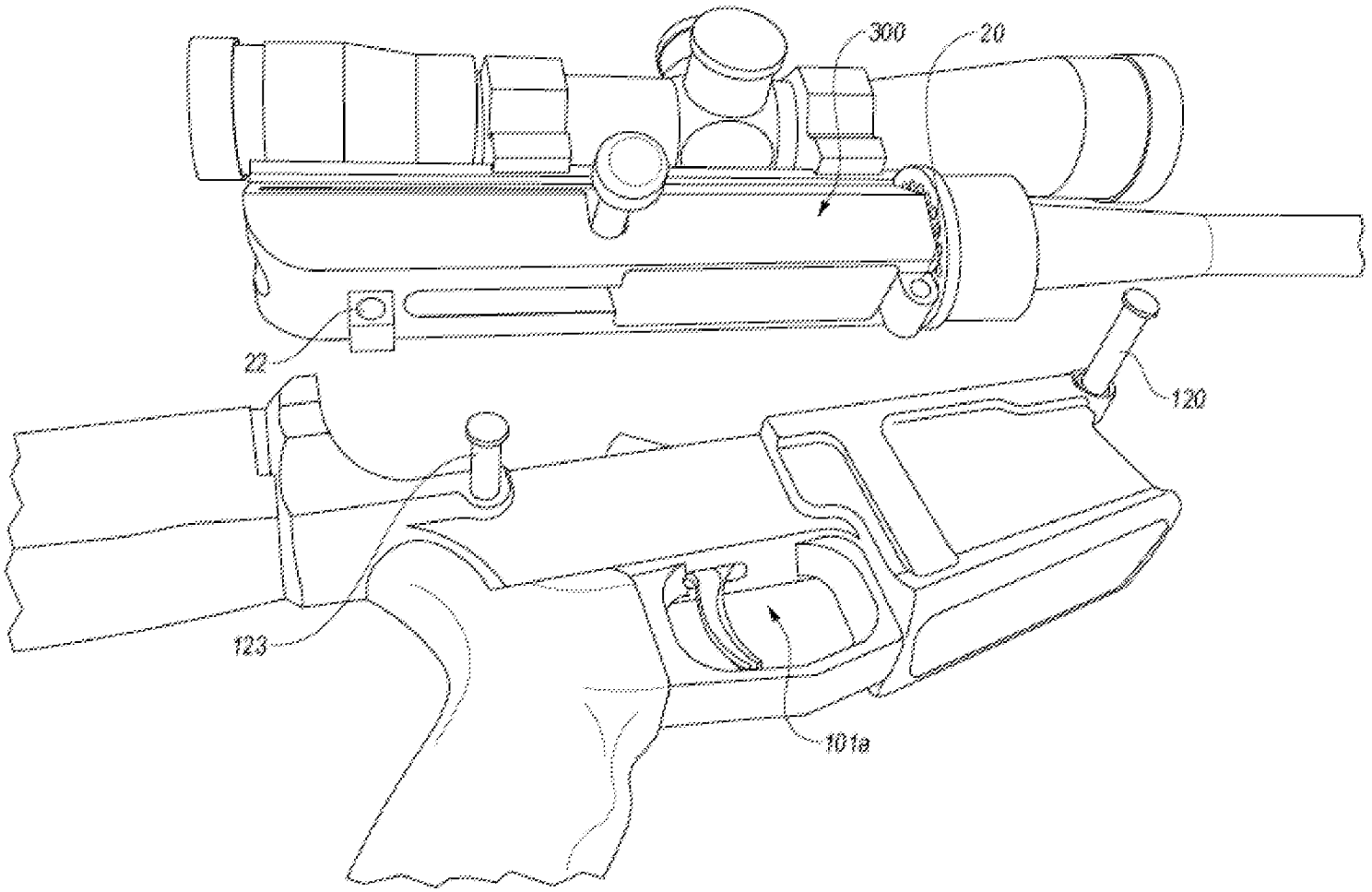
FIG. 2A illustrates a bolt action upper receiver assembly separate from a standard AR lower receiver assembly.
Figure 2B:
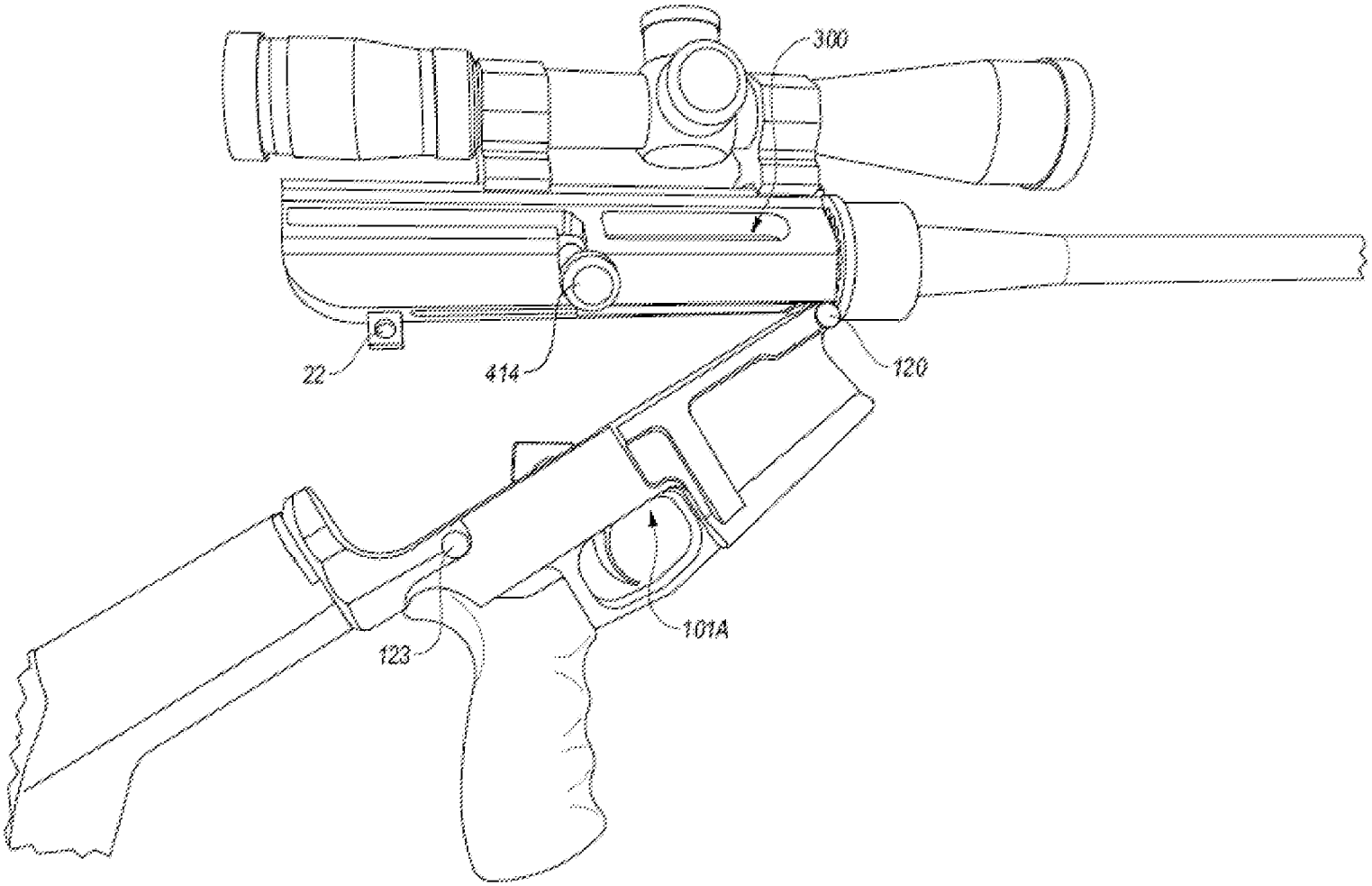
FIG. 2B illustrates a bolt action upper receiver assembly connected via a pivot pin to a standard AR lower receiver assembly.
Figure 2C:
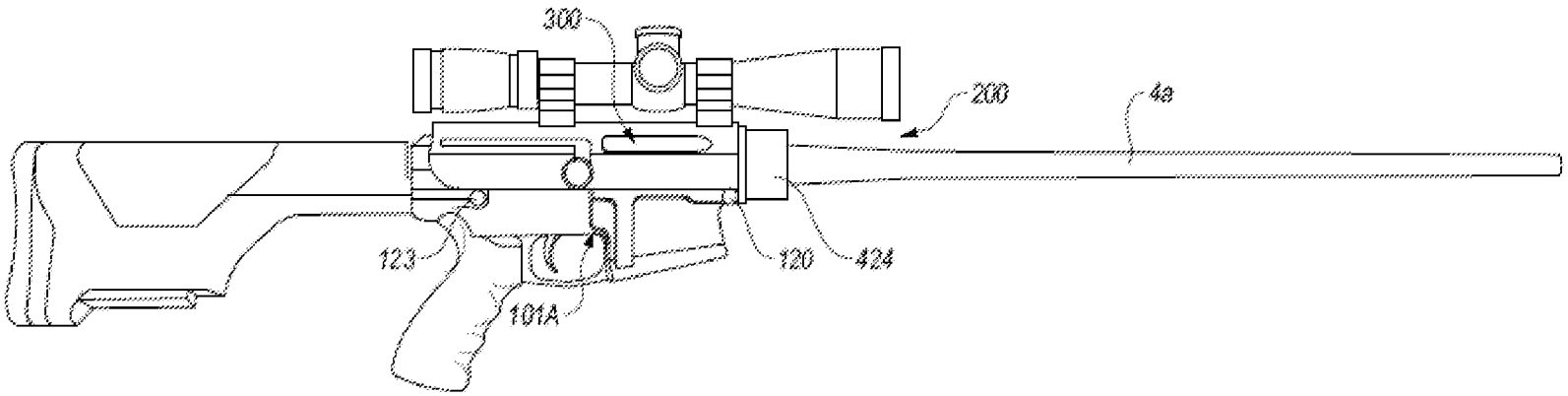
FIG. 2C illustrates a bolt action upper receiver assembly connected via a pivot pin and takedown pin to a standard AR lower receiver assembly.

FIGS. 2A-2C shows an AR-10 bolt action (AR-10 BA) upper assembly 300 separate from the lower assembly 101A and then the coupling of the upper assembly 300 to the lower assembly 101A in order to form the bolt action AR rifle 200 in FIG. 2C. FIG. 2C shows the lower assembly 101A with the pivot pin 120 and takedown pin 123 in the receiver holes to fasten the bolt action (BA) upper assembly 300 to the lower assembly 101A, which is the assembled bolt action AR rifle 200. FIG. 2A shows the upper assembly 300 separate from the lower assembly 101A. It is noted that this lower assembly 101A is the standard lower assembly for the semi-automatic AR rifle. FIG. 2B shows the takedown pin 123 being removed from the upper takedown pin receiver hole 22 so that the back of the BA upper assembly 300 can pivot on the pivot pin 120 in the upper pivot pin receiver hole 20. It is noted that the upper takedown pin receiver hole 22 is in a takedown receiver body, and the upper pivot pin receiver hole 20 is in a takedown pin receiver body. As shown, the takedown pin 123 and pivot pin 120 do not need to be pulled all the way out of the takedown pin receiver hole 139 and pivot pin receiver hole 138, but only from the upper takedown pin receiver hole 22 and upper pivot pin receiver hole 20. Performing the steps from FIG. 2C to 2A disassembles the AR-10 BA, and performing the steps from FIG. 2A to 2C assembles the AR-10 BA. Also, it can be seen that the takedown pin receiver hole 139 is actually two different holes, one on each side of the lower assembly 101A, and thereby the takedown pin 123 only needs to be withdrawn from one and from the upper takedown pin receiver hole 22. Also, it can be seen that the pivot pin receiver hole 138 is actually two different holes, one on each side of the lower assembly 101A, and thereby the pivot pin 120 only needs to be withdrawn from one and from the upper pivot pin receiver hole 20.

In one aspect, the subject matter described herein is related to a DPMS LR-308 pattern BA upper assembly, DPMS LR-308 pattern SA upper assembly, DPMS LR-308 lower assembly, and DPMS AR-10 BA or DPMS AR-10 SA. The subject matter may also relate to AR-15s, SA upper assemblies thereof, BA upper assemblies thereof, and lower assemblies thereof, which may also be DPMS LR-308 patterned. Also, it may be an Armalite AR-10 pattern.

Figure 3A:
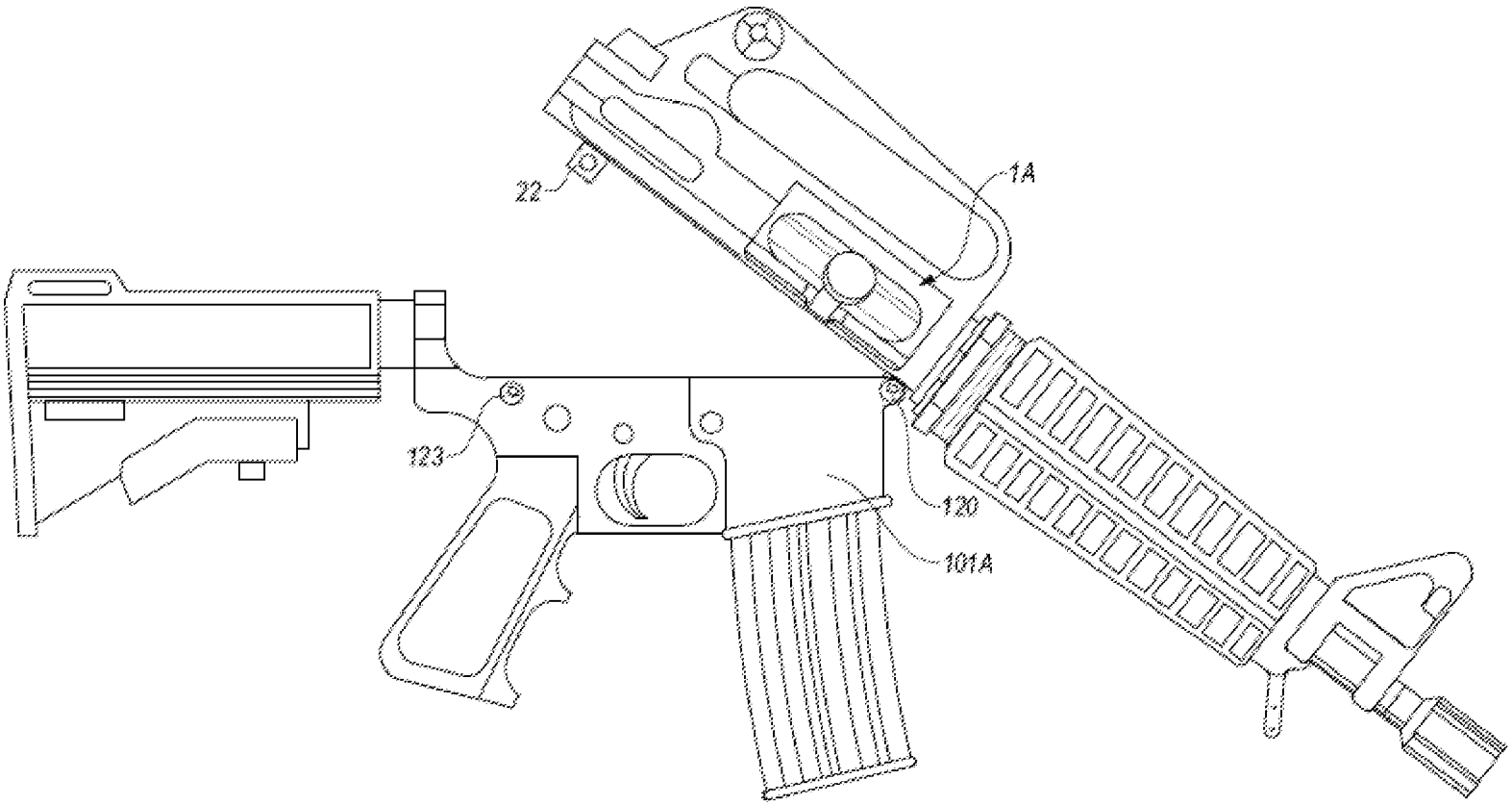
FIG. 3A illustrates a standard AR upper receiver assembly (semi-auto or full auto) being pivotally removed from a standard AR lower receiver assembly with the takedown pin removed therefrom.
Figure 3B:
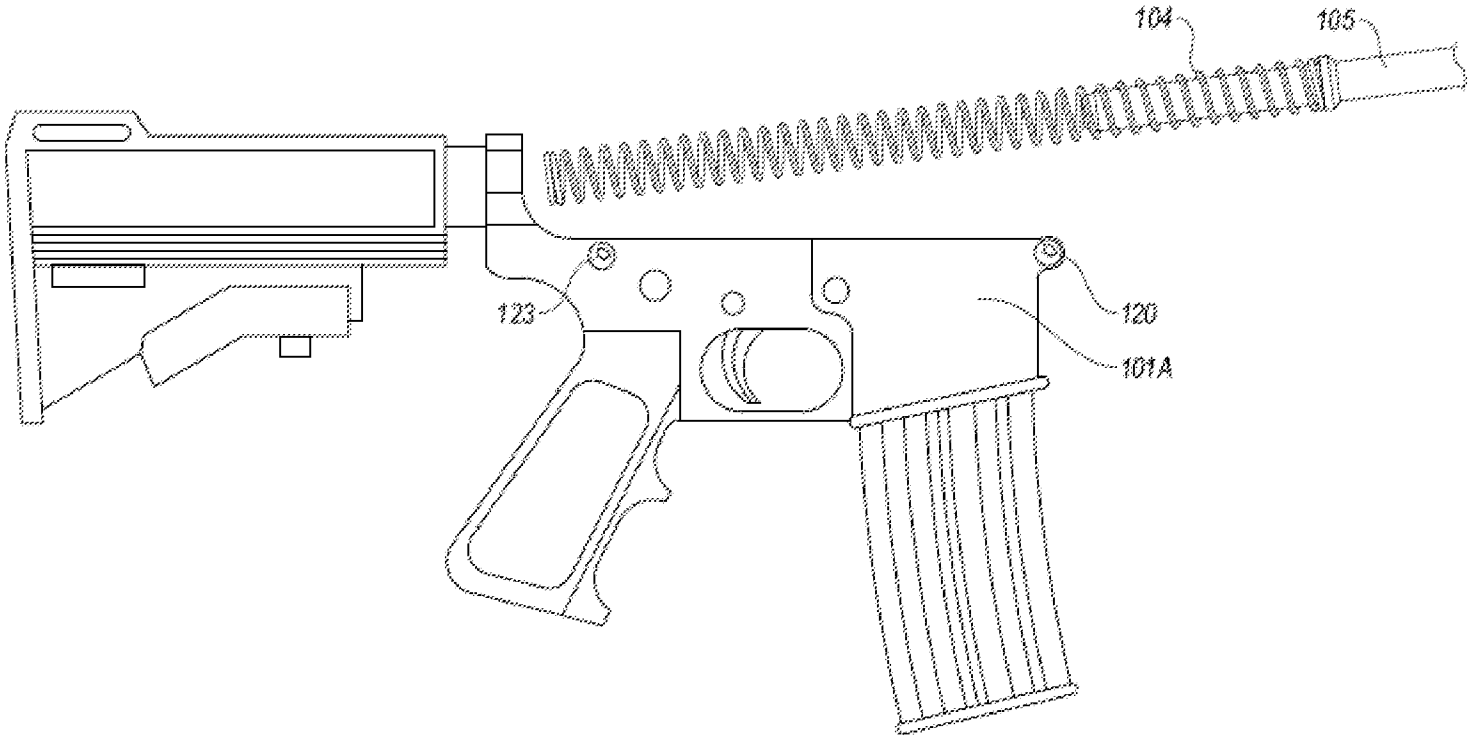
FIG. 3B illustrates a standard AR upper receiver assembly (semi-auto or full auto) removed from a standard AR lower receiver assembly with the takedown pin and pivot pin removed therefrom.

FIG. 1 shows an AR-10 semi-automatic (AR-10 SA) with the pivot pin 120 and takedown pin 123 in the receiver holes to fasten the semi-automatic (SA) upper assembly 1A to the lower assembly 101A. FIG. 3A shows the takedown pin 123 removed from the upper assembly 1A so that the SA upper assembly 1A pivots on the pivot pin 120. FIG. 3B shows the pivot pin 120 removed so that the SA upper assembly (not shown) is detached from the lower assembly 101A. Optionally, the operating spring 104 can be removed or retained therein when the BA upper assembly 300 is mounted to the lower assembly. Performing the steps from FIG. 1A to FIG. 3A to FIG. 3B disassembles the AR-10 SA, and performing the steps from FIG. 3B to FIG. 3A to FIG. 1 assembles the AR-10 SA.

Accordingly, the present invention can include a BA upper assembly that mounts to a lower assembly to form an AR-10 BA rifle. The present invention can also can also include the AR-10 BA rifle having the BA upper assembly mounted to the lower assembly. The present invention can also include a kit including the lower assembly with the SA upper assembly and BA upper assembly. The present invention may also include a method of converting an AR-10 SA rifle into an AR-10 BA rifle. The present invention may also include a method of attaching a BA upper assembly to a lower assembly to form the AR-10 BA rifle. The present invention may also include a method of disassembling an AR-10 BA rifle into a BA upper assembly and a lower assembly. Other assemblies, guns, kits, systems, and methods of making/assembling or methods of disassembling are also included. The methods may include assembling and/or disassembling the BA upper assembly. The individual components of the BA upper assembly may also be embodiments of the invention.

Figure 4A:
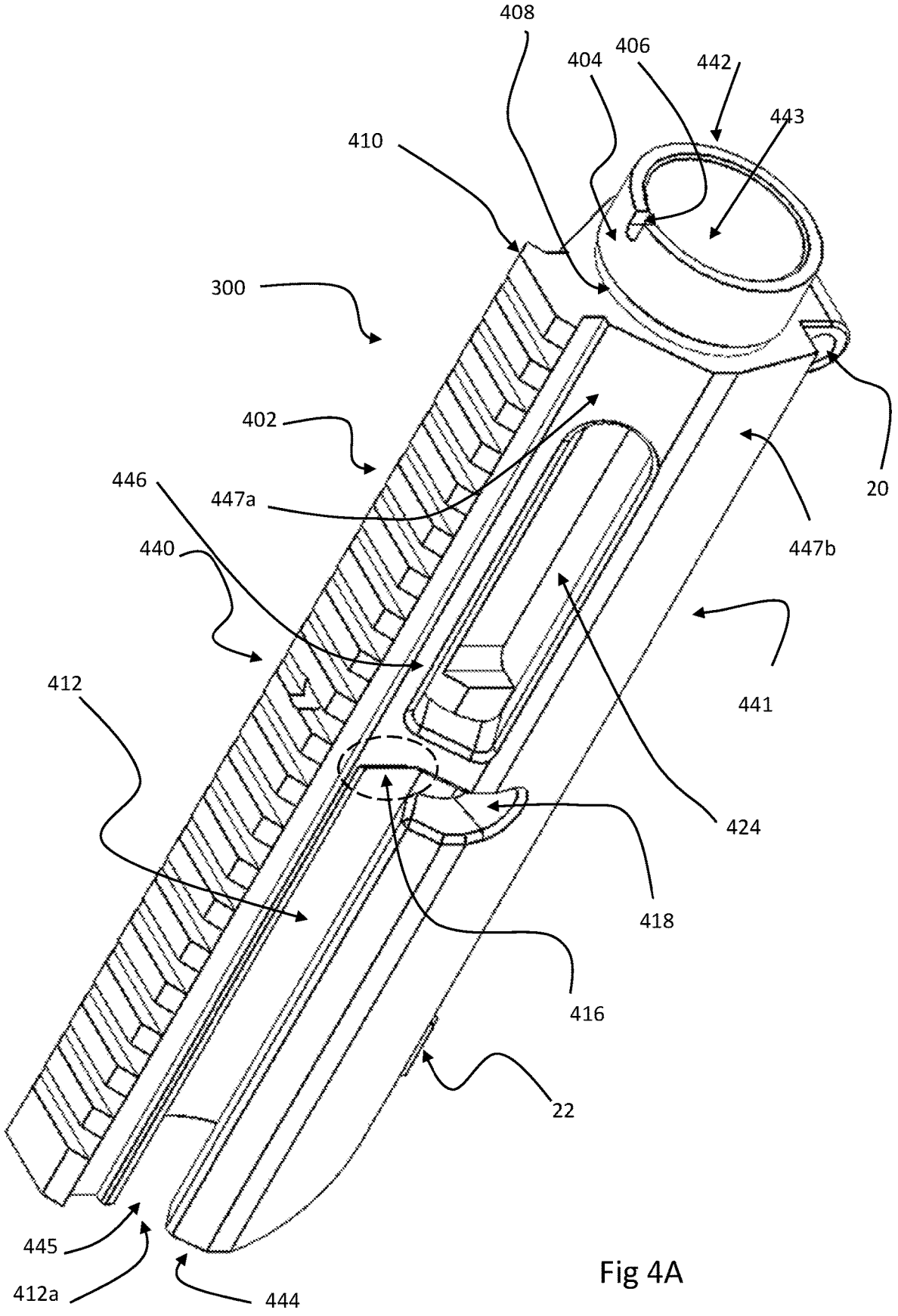
FIGS. 4A to 4D illustrate different views of an embodiment of a bolt action upper receiver configured to be coupled with a standard AR lower receiver assembly.
Figure 4B:
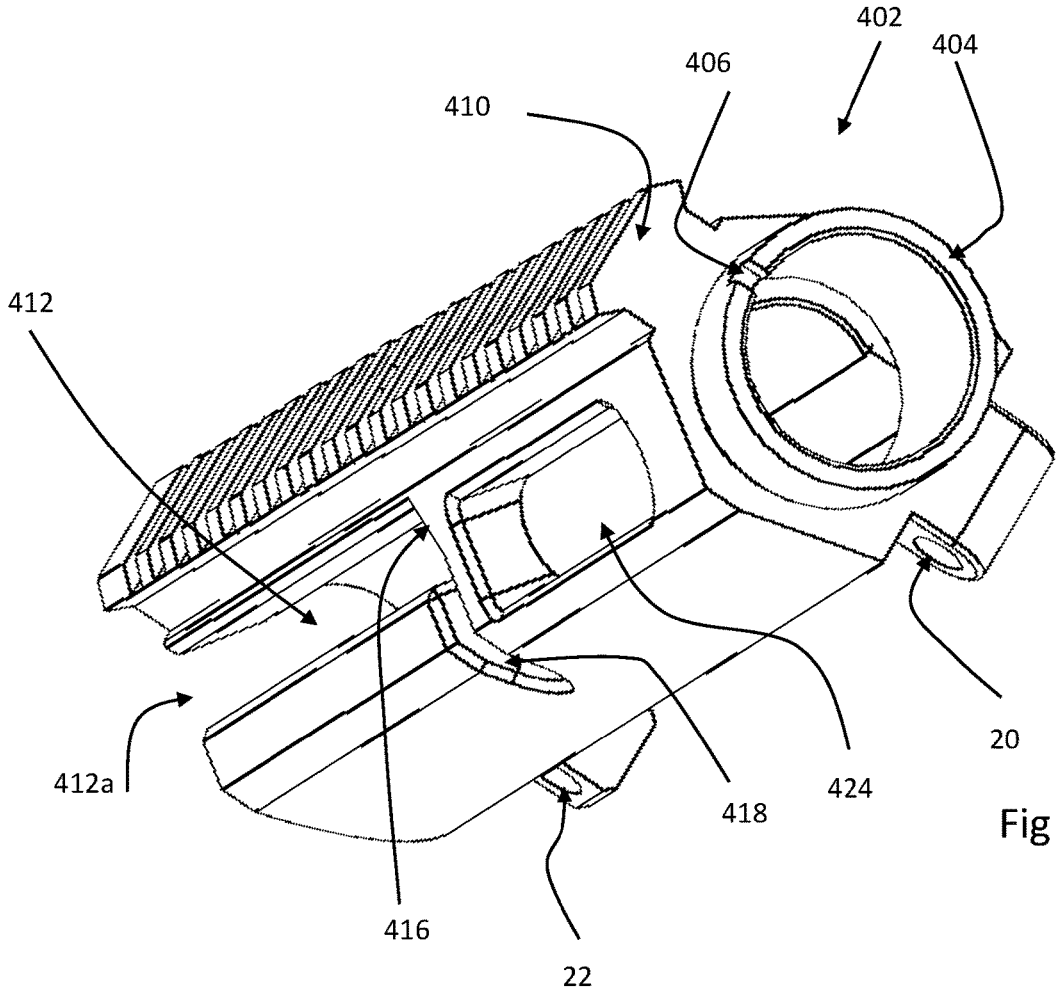
Figure 4C:
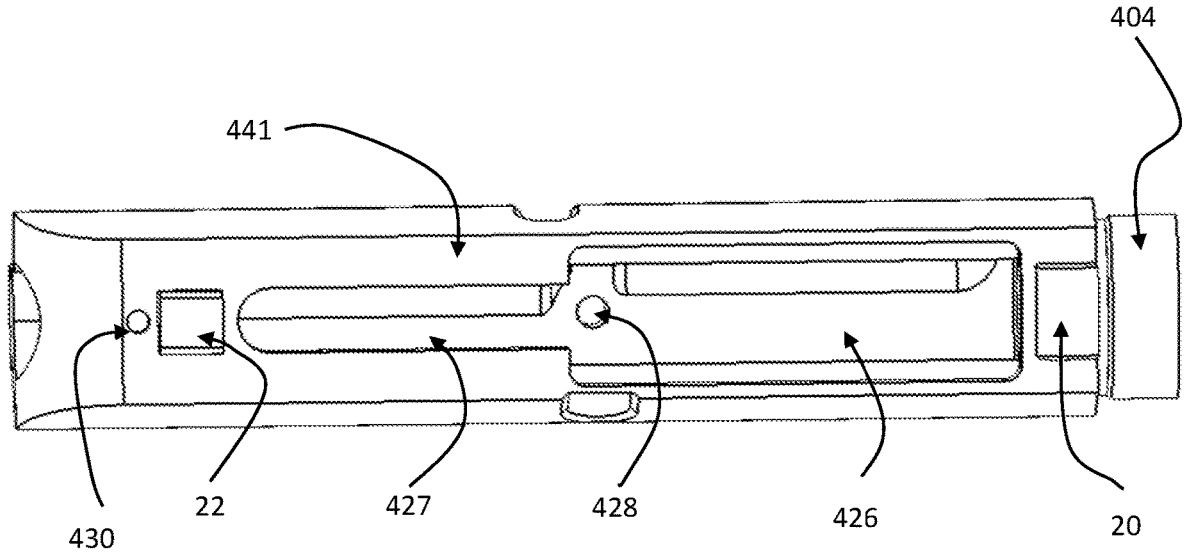
Figure 4D:
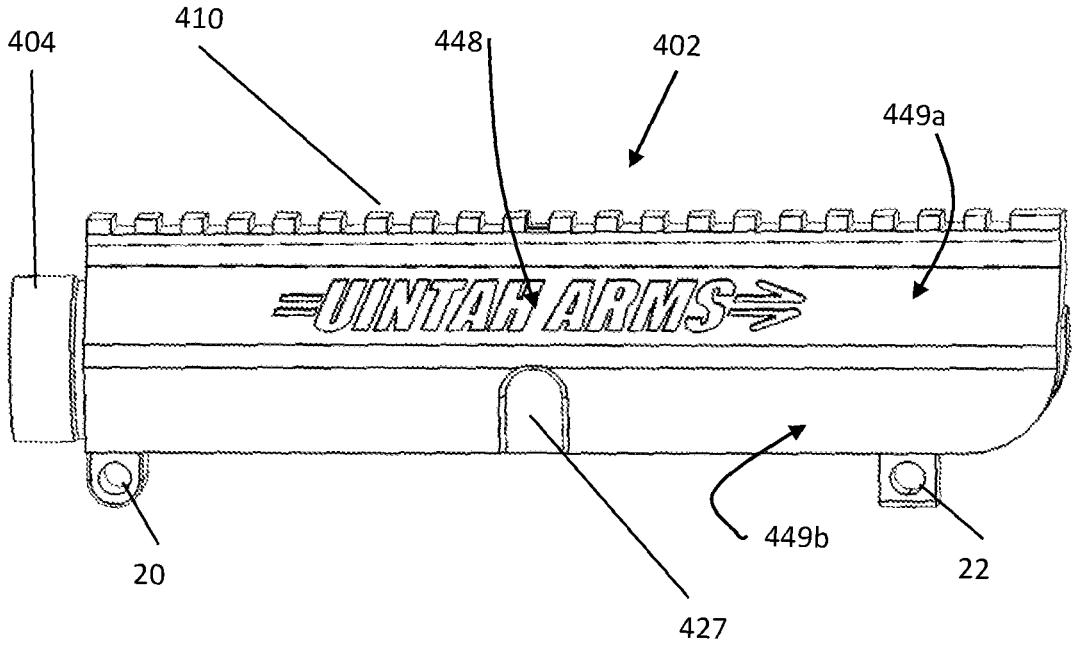

FIGS. 4A-4D show different views of the upper receiver 402 of a BA upper assembly 300, which is configured for bolt action firing. FIG. 4B shows a perspective view and FIG. 4C shows a bottom view of the upper receiver 402. The bottom view of FIG. 4C shows that the same magazines of an AR-10 SA may fit into the BA upper assembly 300 and thereby the AR-10 BA. FIG. 4D shows the other side of the upper receiver 402. FIGS. 6A-6D show the barrel extension nut 420. FIGS. 6A-6D show different perspectives of the bolt 450.

The receiver 402 includes a threaded receiver 404 for receiving the barrel, which threaded receiver 404 is shown without threading. A barrel extension nut 420 (FIG. 5A) is adapted to be received onto the threaded receiver 404. A threaded relief 408 is behind the threaded receiver 404. The threaded receiver 404 includes a dowel pin receiver 406 that is configured to receive a dowel pin, where the dowel pin keys into the dowel pin receiver 406. The threaded receiver 404 is threaded the same as an AR upper receiver. The barrel threads into the barrel extension nut 420, and then the barrel extension nut 420 slides in the receiver 402 into a tight fitting so that the dowel pin hole 422 of the barrel extension nut 420 aligns with the dowel pin receiver 406, and then the dowel pin is received into the dowel pin hole 422 and dowel pin receiver 406. The barrel extension nut 420 (FIGS. 5A-5C) then goes over the barrel 4A and tightens to the threaded receiver 404, where the barrel extension nut 420 is on the outside and locks down the barrel to the receiver 402. As such, the barrel 4*a* may be attached to the upper assembly 300 by threading it into the barrel extension nut 420 that is then mounted to the receiver 402. A barrel extension nut 420 can be used to attach the barrel into the receiver 402.

FIG. 4A shows the receiver 402 having the picatinny rail 410 for scope adjustment, which has grooves for receiving a sight or scope. For example, the picatinny rail 410 can be configured with the 20 MOA slope, which allows for more accurate long distance shooting. The picatinny rail 410 also allows for better usage of internal adjustment mechanisms of a scope that can be attached thereto, which is beneficial for long distance shooting. Here, the picatinny rail 410 is integrated, but it could be a separate part. The reason why it is integrated is that the bolt action allows for longer range shooting with accuracy, which can be facilitated with the 20 minute slope of the rail 410. It also allows for more rigidity that enhances shooting accuracy.

The receiver 402 includes the upper pivot pin receiver hole 20 for receiving the pivot pin 120 and the takedown pin receiver hole 22 for receiving the takedown pin 123 as shown in other figures.

The receiver 402 is shown to include the bolt handle slot 412 for receiving the bolt handle 414 (FIG. 2B), which bolt handle 414 can slide therealong while actuating the bolt action. The distal end of the bolt handle slot 412 includes an extractor ramp 416 that is configured for facilitating extraction of the brass by actuation of the bolt handle 414 by being guided thereby when being removed from the bolt rest 418. The other end of the bolt handle slot 412 is open as shown at 412*a*. The brass is then ejected through the ejection port 424. When the bolt handle 414 is in the bolt rest 418 and pulled down into it and seated, then the rifle can fire. If the bolt handle 414 is not all the way seated into bolt rest 418, the rifle will not fire because the bolt 450 (FIG. 6A) is designed to inhibit the hammer from properly actuating unless the bolt handle 414 is fully seated in the bolt rest 418, which is described in more detail herein.

The extractor ramp 416 (in dashed circle) is angled from the bolt rest 418 toward the bolt handle slot 412 to facilitate extraction of the brass from the ejection port 424. As can be seen, the bolt rest 418 and bolt handle slot 412 are at roughly 90 degrees, however, the distal or forward edge (e.g., opposite of 412*a*) has the extractor ramp 416 at an angle between the bolt rest 418 and bolt handle slot 412 instead of a 90 degree angle. This extractor ramp 416 is provided to push the bolt handle 414 in an amount and direction to initiate extraction of the brass from the chamber. The extractor ramp 416 also facilitates easier proximal or backward pulling of the bolt handle 414. In some instances if heating occurs, the brass may get stuck in the chamber, and upon manipulating the bolt handle 414 from the bolt rest 418 into the extractor ramp 416 can cause the bolt handle 414 to be pushed proximal or backwards toward the shooter in order to enhance brass extraction.

Also shown in FIGS. 4A-4D are the top 440, bottom 441, distal end 442 having the barrel opening 443, proximal end 444 having the bolt opening 445, the first side 446 having the first side upper surface 447*a*, first side lower surface 447*b*, and second side 448 (e.g., having a logo or other indicia) having the second side upper surface 449*a* (e.g., containing the logo or other indicia as shown) and second side lower surface 449*b*.

FIG. 4B shows a perspective view of some of the features of the receiver 402.

FIG. 4C shows the bottom of the receiver 402, and shows the magazine slot 426 configured for receiving the magazine, which within includes the detent ball 428. The magazine slot 426 opens into the hammer slot 427 (e.g., hammer slot 427 narrower, proximal, and fluid with the magazine slot 426) configured for allowing the hammer to actuate therethrough. The detent ball 428 (in a detent recess) matches a recess 432 in the bolt 450 so that the bolt 450 stays closed and does not rattle open or rattle around during use. There is a spring in the detent recess that resiliently pushes the detent ball 428 outward so that the detent ball 428 can be pushed into the detent recess.

Near the upper takedown pin receiver hole 22, there is a threaded hole 430. The threaded hole 430 is adapted to receive a bolt therein so that the receiver 402 can be bolted to the lower assembly, where a fastener (e.g., threaded fastener, such as a screw etc.) can be passed through the lower assembly into the receiver 402 and threaded into the threaded hole 430. This can increase rigidity of the mounted receiver 402 into the lower assembly and increase accuracy of firing. Such a coupling with a fastener is optional, and if used is removed along with the takedown pin 123 and pivot pin 120.

FIG. 4D shows the other side of the receiver 402, which shows the magazine release receiver recess 427, which receives the magazine release button. It should be noted that the receiver 402 is contoured to fit into the lower assembly, such as the back being rounded for a tight fitting.

Figure 5A:
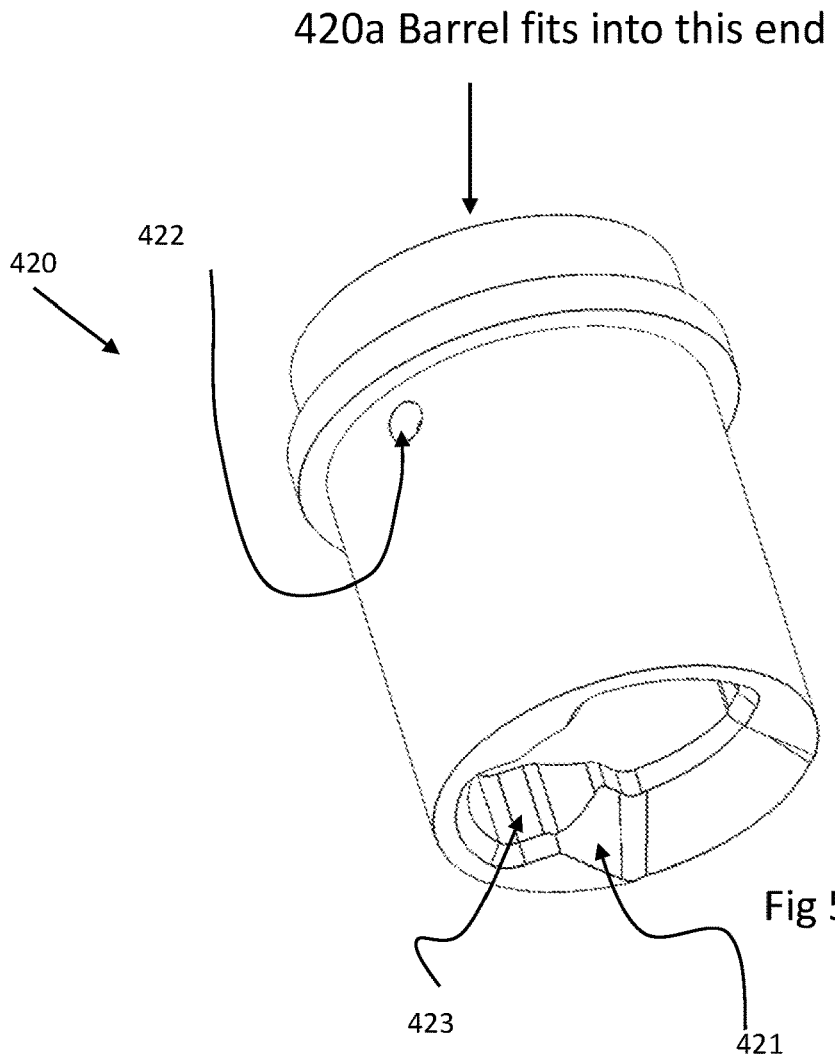
FIGS. 5A-5C illustrate different views of an embodiment of a barrel extension nut.
Figure 5B:
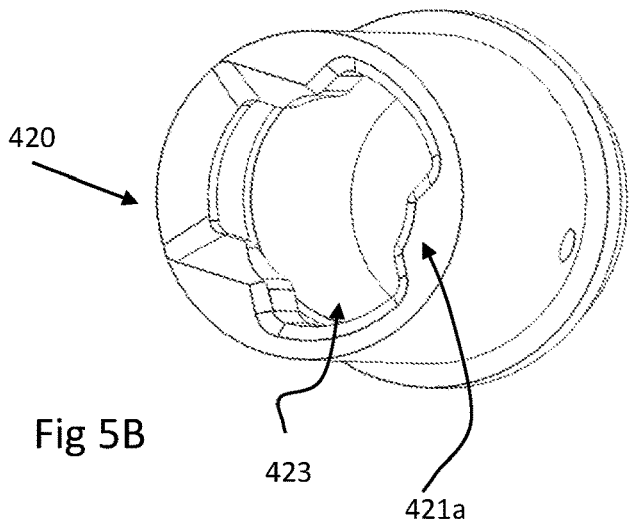
Figure 5C:
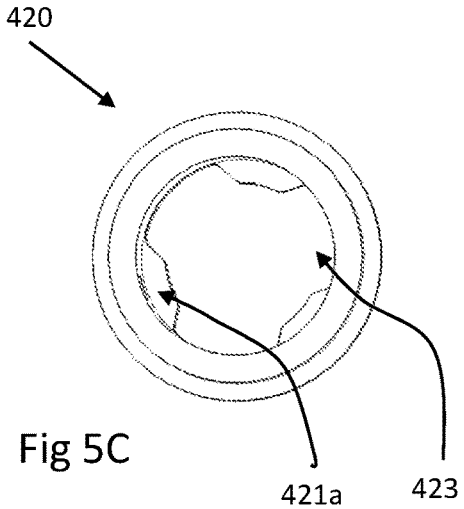

FIGS. 5A-5C show the barrel extension nut 420 having the dowel pin hole 422. Also, the barrel extension nut 420 includes a shell guide ramp 421 on nut lugs 421*a* that are sloped to guide shells. The barrel extension nut 420 also includes reliefs 423 between the nut lugs 421*a* for receiving the bolt head lugs 460 of the bolt head 458.

During operation, the bolt head 458 passes through relief 423, and then as the bolt 450 is rotated to be closed and to be in a firing position, the bolt head 458 spins in the relief 423 behind the lugs 460 on the barrel extension nut 420. This allows proper engagement when manually engaging the bolt into a firing position.

Figure 6A:
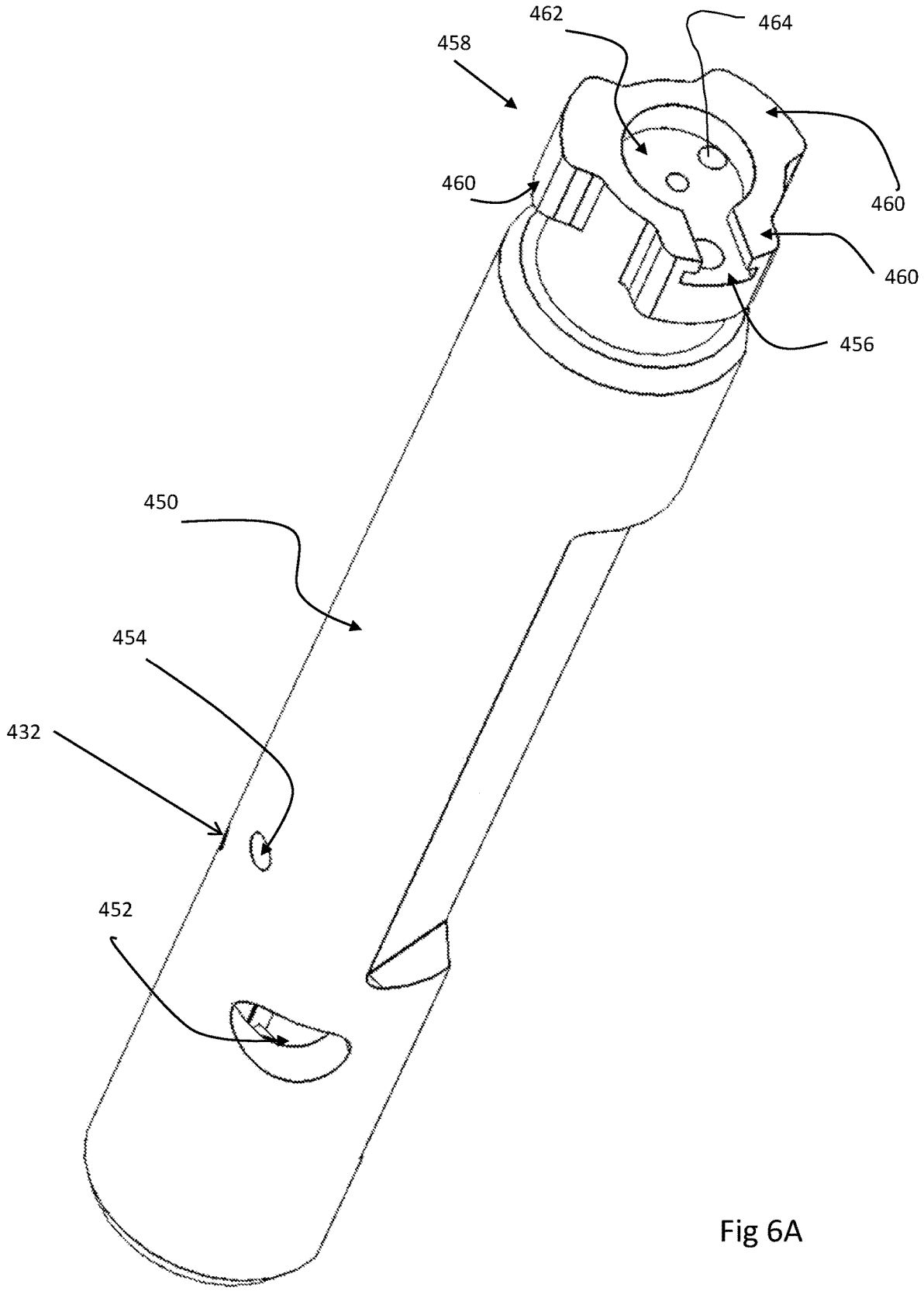
FIGS. 6A-6D illustrate different views of an embodiment of a bolt for a bolt action upper assembly to convert an AR rifle to a bolt action AR rifle.
Figure 6B:
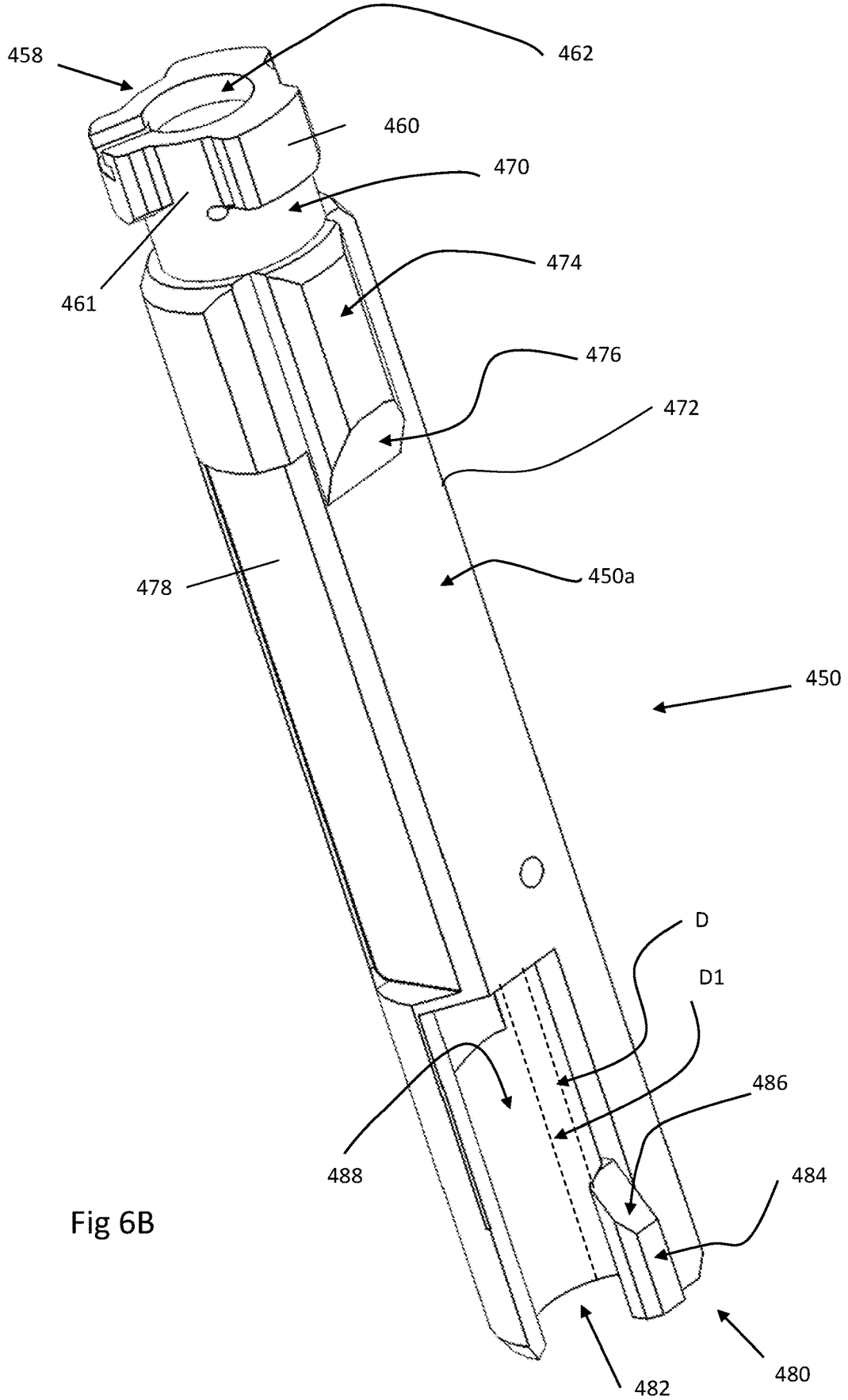
Figure 6C:
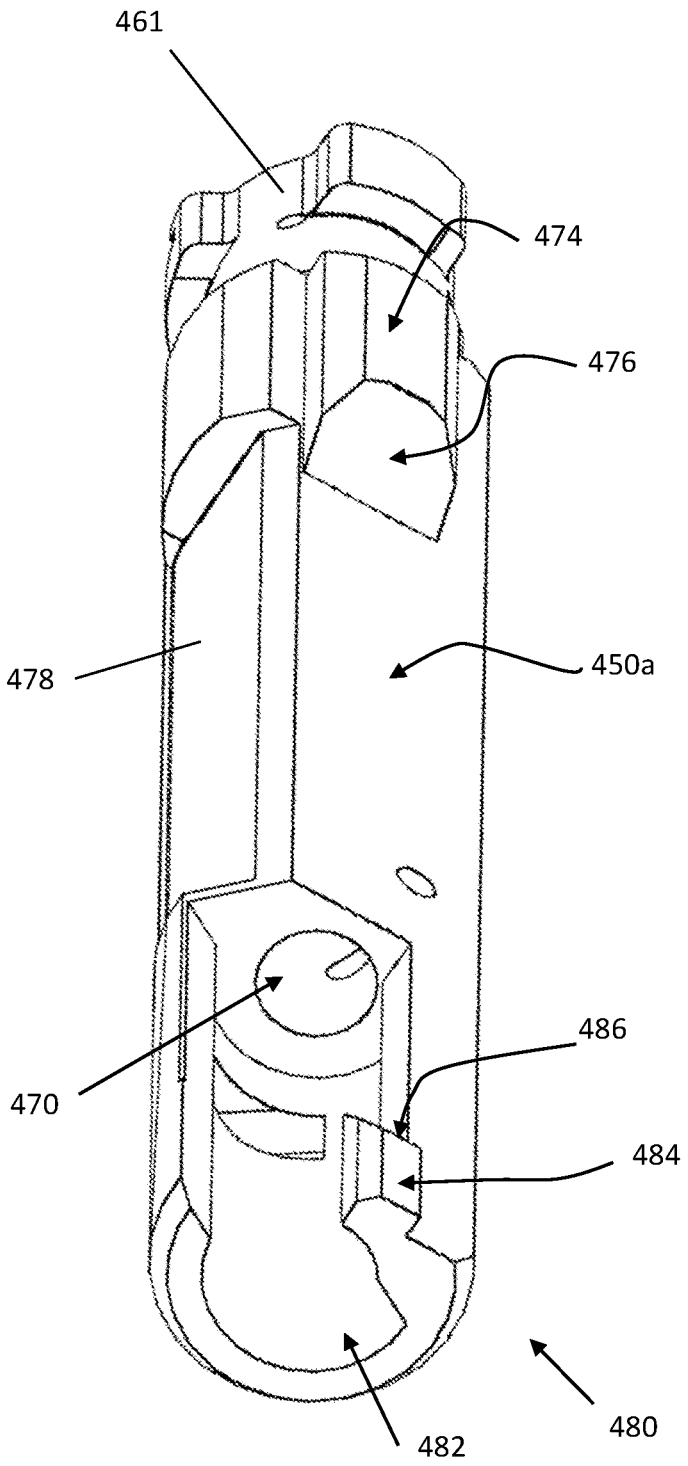

FIG. 6A shows the bolt 450, which includes the firing pin 470 therein (FIG. 6C). The bolt 450 includes the bolt handle hole 452 for coupling with the bolt handle 414, and whereby the bolt handle hole 452 is aligned with the bolt handle slot 412 when the bolt 450 is in the receiver 402. The bolt 450 may optionally include a roll pin hole 454 for holding the firing pin; however, there are other options for retaining the firing pin. The bolt 450 also includes an extractor slot 456 in the bolt head 458 having bolt head lugs 460 (e.g., 3 of them). One of the bolt head lugs 460 includes the extractor slot 456, which can include the extractor components to facilitate extraction of the brass from the chamber. The bolt head lugs 460 fit into the relief 423 of the barrel extension nut 420. The bolt head 458 has a bolt head recess 462 that also has holes, such as the spring plunger hole 464 that houses a springed plunger (not shown) to facilitate ejection of brass.

When included, the roll pin hole 454 receives a roll pin (not shown), which holds the firing pin in. The firing pin is free floating. The firing pin can be any standard AR-10 firing pin. In one option, the firing pin can be a DPMS LR-308 AR firing pin, such as AR-10 (e.g., Armalite AR-10) or AR-15.

FIG. 6B shows a bottom side 450*a* of the bolt 450 with the bolt head 458, bolt neck 470 adjacent to the bolt head 458, and bolt body 472. Near the bolt neck 470, the bolt body 472 includes a bullet pushing ridge 474 that has a bullet pushing slope 476 opposite of the bolt head 458 across the bolt neck 470. The bullet pushing ridge 474 may extend further down the bolt body 472 as needed or desired (illustrated in another embodiment) and function for hammer pushing. On the side of the bolt body 472 (e.g., orthogonal with the bottom side) is a magazine recess 478 that has a surface that when the bolt 450 is closed, the magazine recess 478 allows operation of the magazine.

Opposite of the bolt head 458 is a bolt end 480 that has a firing pin recess 482 for retaining the firing pin therein. The firing pin recess at the bolt end 482 is next to an end ridge 484 with an end ramp 486. The end ridge 484 and end ramp 486 allow for proper operation of the rifle by setting the hammer in a locked position. The end ridge 484 keeps the hammer set in the locked position while the bolt 450 is in the open position all of the way forward. The end ramp 486 is what pushes the hammer back down once it has come off of the hammer ridge 490 while pushing the hammer forward after firing the rifle so that the hammer can again rest on the end ridge 484 before closing the bolt 450.

There is an end slot 488 at the firing pin recess 482 next to the end ramp 486, where the end slot 488 has a dimension D from the end ridge 484 and/or end ramp 486 and a dimension D1 from the end 482. The dimension D is configured for hammer clearance in the end slot 488. The dimension D1 is from the end and allows for operation, with the end ridge 484 extending from the body 472 to make the end slot 488 shaped as shown. The end ridge 484 can keep the gun from shooting by keeping the hammer set in the locked position, but once the hammer is in the end slot 488, the hammer can release. Thus, when the bolt 450 is open, the rifle can't shoot, but when the bolt 450 is closed the hammer is in the end slot 488 and the rifle is able to fire.

The AR has a swinging hammer that is received into the end slot 488, and which strikes the firing pin within the bolt 450. When the bolt 450 is drawn back, it pushes the hammer back, and the hammer pushing ridge (e.g., end ridge 484) sets the hammer.

Figure 6D:
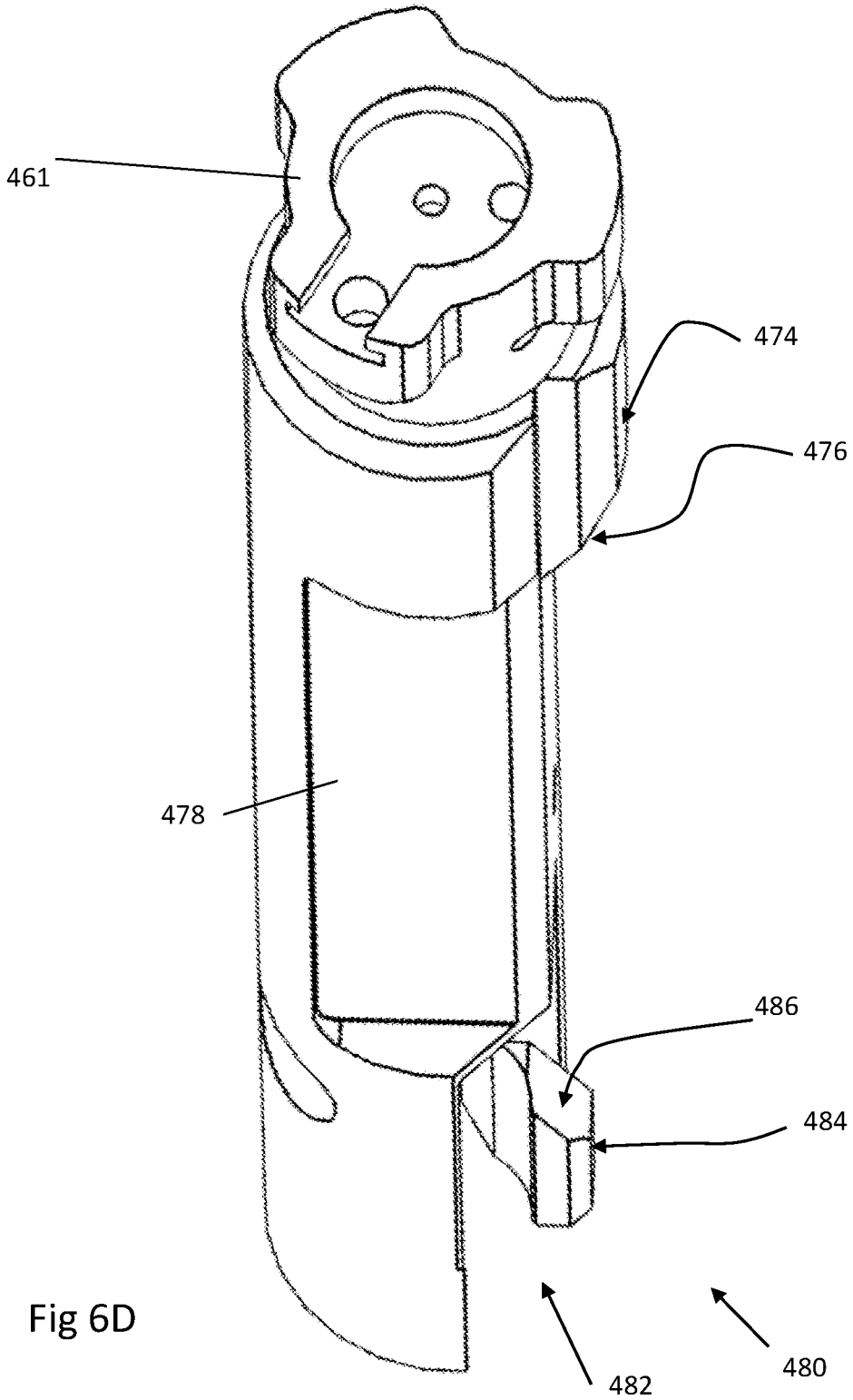
Figure 7A:
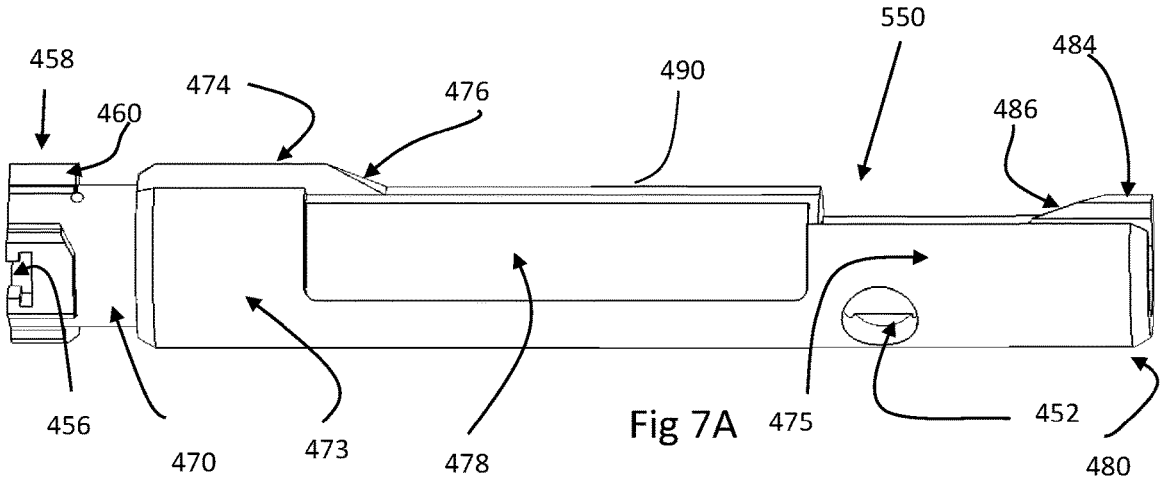
FIGS. 7A-7I illustrate different views of an embodiment of a bolt for a bolt action upper assembly to convert an AR rifle to a bolt action AR rifle.
Figure 7B:
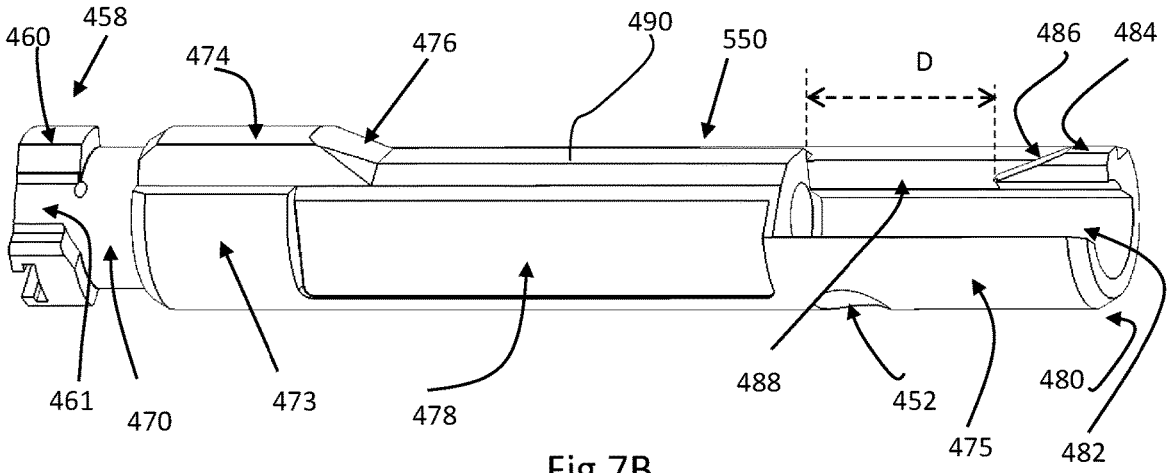
Figure 7C:
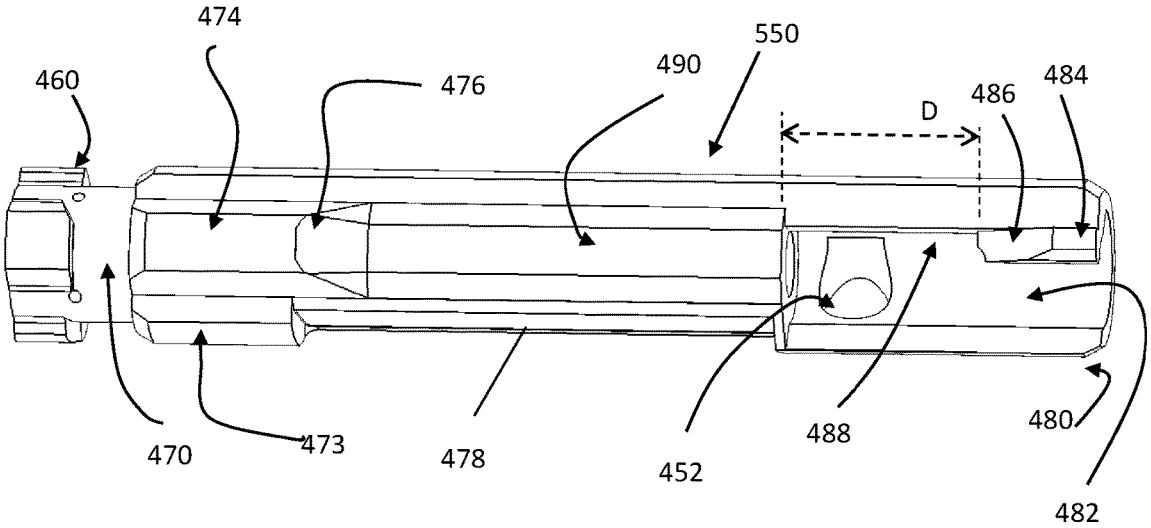
Figure 7D:
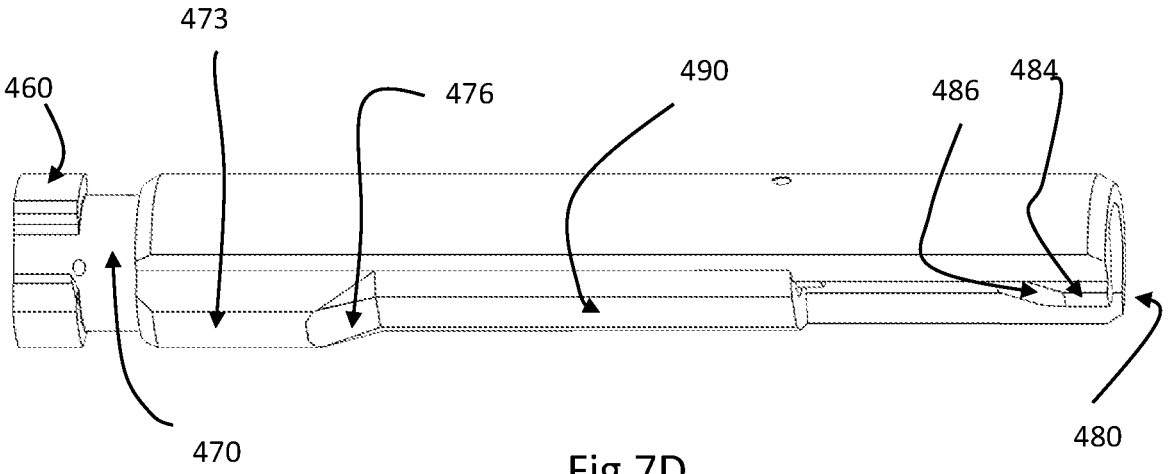
Figure 7E:
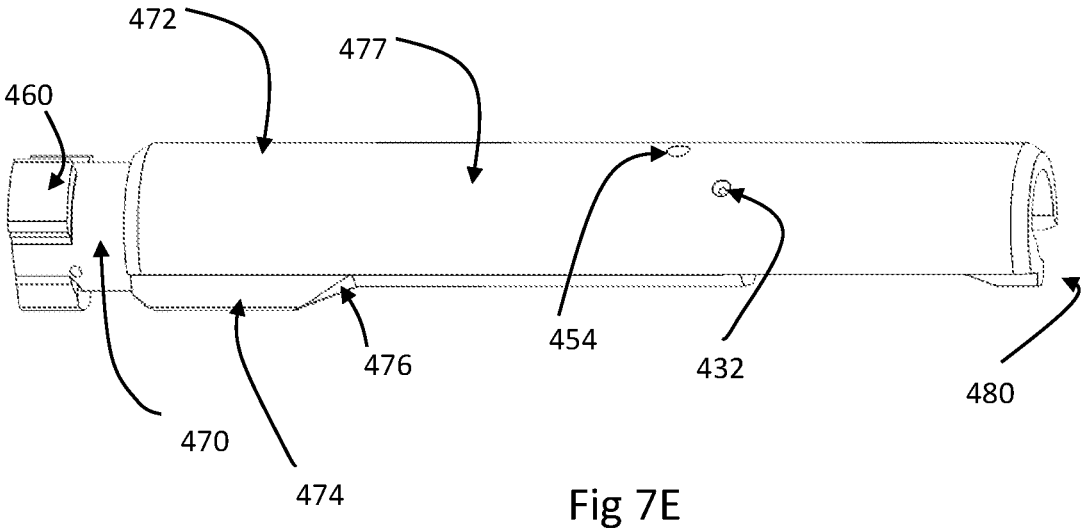
Figure 7F:
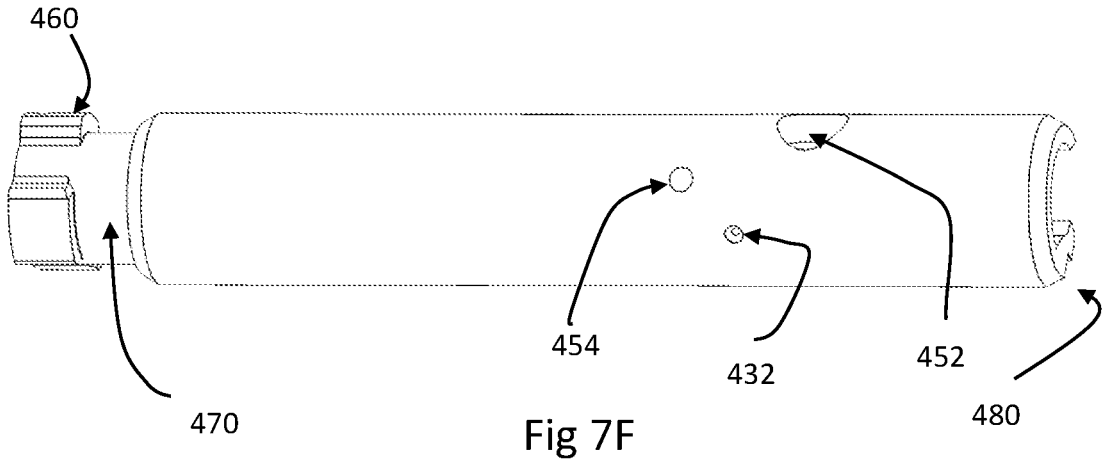
Figure 7G:
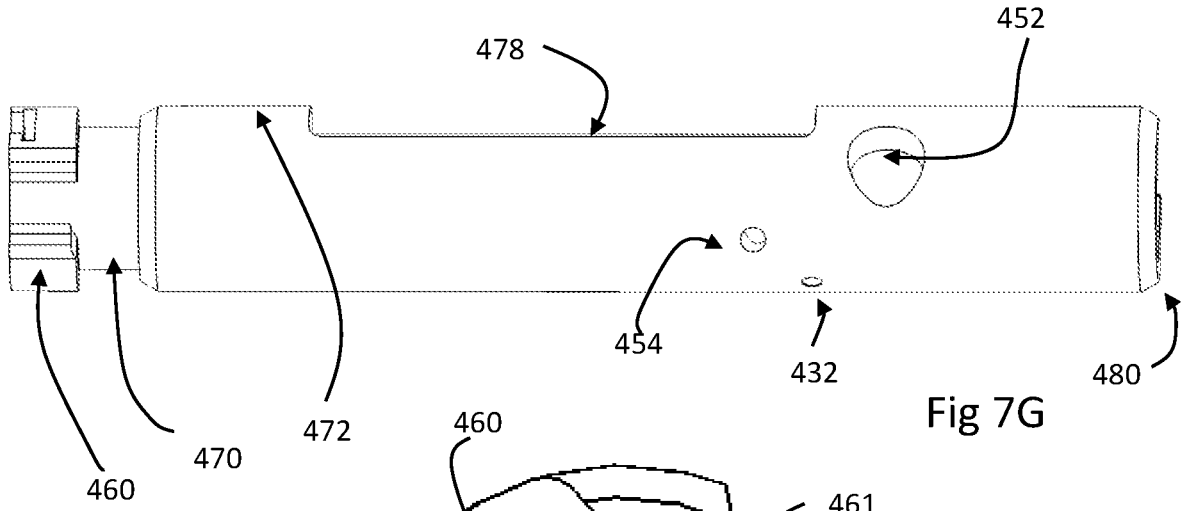
Figure 7H:
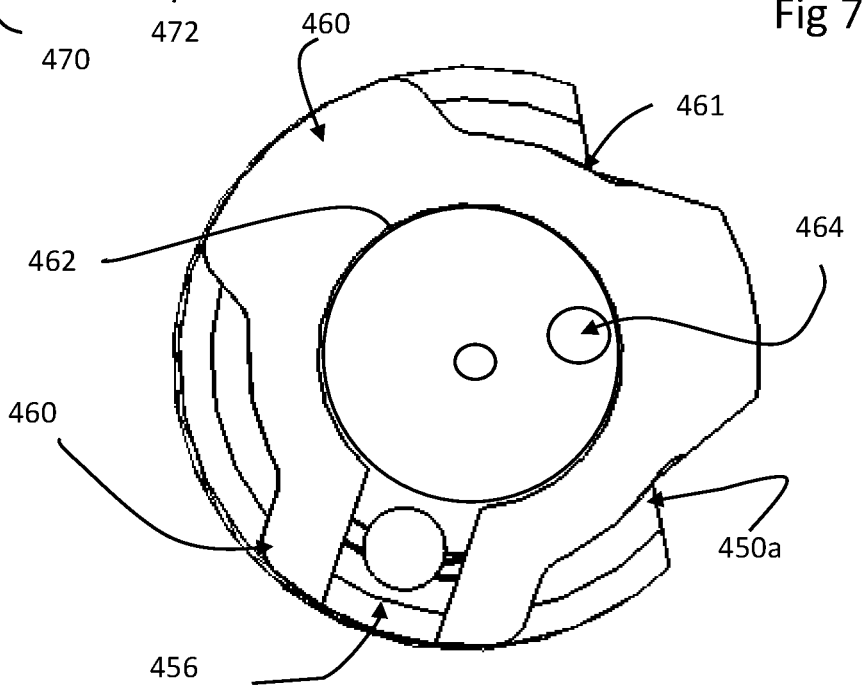
Figure 7I:
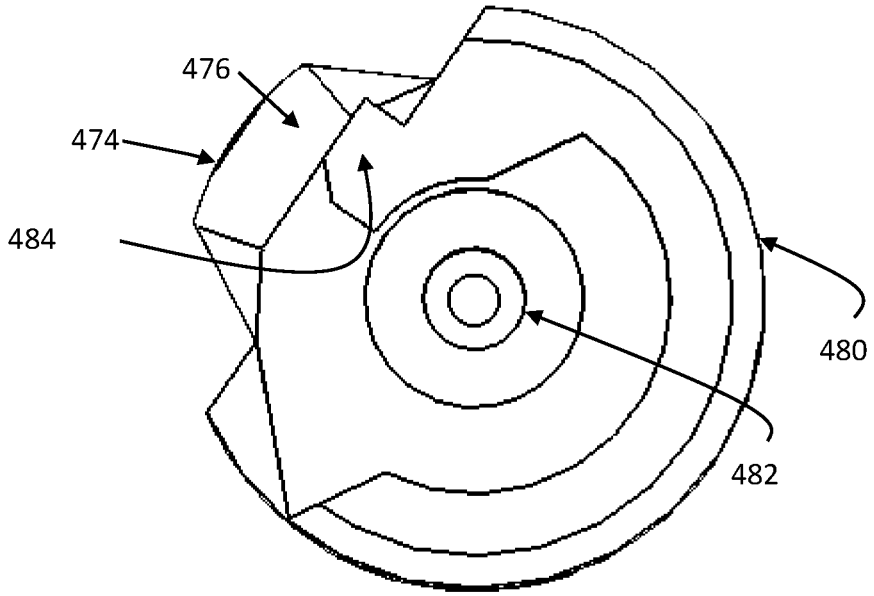

FIGS. 6C and 6D show alternate views showing components of the bolt 450. It is noted that the bolt 450 is a unitary member, which is advantageous for the simple method of conversion from semi-automatic to bolt action.

FIGS. 7A-7G show different views of an alternative bolt 550 that is adapted for enhanced security and safety. Different views are from rotation of the bolt 550 to show all of the features thereof. This bolt 550 does not allow for the rifle to fire unless the bolt handle 414 is seated down into the bolt rest 418. A lot of the features of the bolt 450 are included in the bolt 550, which include the same element numbers.

FIGS. 7A-7I show different views of the bolt 550, which includes the bolt neck 470 therein. The bolt 550 includes the bolt handle hole 452 for coupling with the bolt handle 414, and whereby the bolt handle hole 452 is aligned with the bolt handle slot 412 when the bolt 550 is in the receiver 402. The bolt 450 also includes an extractor slot 456 in the bolt head 458 having bolt head lugs 460 (e.g., 3 of them). One of the bolt head lugs 460 includes the extractor slot 456, which can include the extractor components to facilitate extraction of the brass from the chamber. The bolt head lugs 460 fit into the relief 423 of the barrel extension nut 420. It should be noted that the bolt head 458 includes the bolt head lugs 460 separated by bolt head reliefs 461, and the barrel extension nut 420 includes the nut lugs 421*a* separated by the nut relief 423. When actuated, the bolt head lugs 460 pass through the nut reliefs 423 and the nut lugs 421*a* pass through the bolt head relief 461, and then when rotated the bolt head lugs 460 are aligned with the nut lugs 421*a* so that the bolt head relief 461 is aligned with the nut reliefs 423.

The bolt 550 is shown with the bolt head 458, bolt neck 470 adjacent to the bolt head 458, and bolt body 472. Near the bolt neck 470, the bolt body 472 includes a bullet pushing ridge 474 that has a bullet pushing slope 476 opposite of the bolt head 458. The bullet pushing ridge 474 may extend further down the bolt body 472 as needed or desired and function for hammer pushing. On the side of the bolt body 472 is a magazine recess 478 that has a surface that when the bolt 550 is closed, the magazine recess 478 allows operation of the magazine.

Opposite of the bolt head 458 is a bolt end 480 that has firing pin recess 482 for retaining the firing pin therein. The firing pin recess 482 is next to an end ridge 484 with an end ramp 486.

Also shown are a first body portion 473 and second body portion 475 at the ends of the magazine recess 478. The first body portion 473 and second body portion 475 are portions of the cylindrical portion 477.

From the bullet pushing slot 476 is a hammer pushing ridge 490, which is adapted to push the hammer down and keeps the gun from firing until the bolt 550 is locked. The hammer pushing ridge 490 can have the same height from the bolt body 472 as the end ridge 484. There is an end slot 488 at the firing pin recess 482, where the end slot 488 has a dimension D from the end ridge 484 and/or end ramp 486 to the hammer pushing ridge 490. The dimension D is configured for hammer clearance in the end slot 488. The hammer pushing ridge 490 can keep the gun from shooting by preventing the hammer from setting, but once the hammer is in the end slot 488, the hammer can set. Thus, when the bolt 550 is open, the gun can't shoot, but when the bolt 550 is closed the hammer is in the end slot 488 and the gun is able to fire.

The AR has a swinging hammer that is received into the end slot 488, and which strikes the firing pin within the bolt 550. When the bolt 550 is drawn back, it pushes the hammer back, and the hammer pushing ridge 484 sets the hammer.

The hammer pushing ridge 490 is dimensioned to keep the hammer cocked and the hammer set so that it cannot shoot until the bolt 550 is fully set with the bolt handle 414 in the bolt rest 418. The hammer pushing ridge 490 is shaped to make sure the hammer is held to that certain point where the gun will not fire even after the bolt is closed. Because if the hammer is not held properly, an operator can pull the trigger and as soon as the bolt is closed, the hammer can go off. Now with the hammer ridge 490 abutting and extending from the bullet pushing ridge 474 or slope 476 all the way to the end slot, the upper receiver 402 is safe and not allowed to fire until the trigger is pulled. This is surprising and unexpected that such a hammer pushing ridge 490 or combination of the hammer pushing ridge 490 with the bullet pushing ridge 474 or slope 476 extending to the end slot 488 can make the bolt action upper assembly 300 safe to mount to a lower assembly to form the AR-10 BA rifle. As such, the end slot 488 is configured for hammer clearance so the hammer clears when the bolt 550 is in firing position.

The dimension D is important for hammer clearance. The dimension D can be about 1", or +/−1%, 2%, 5%, or 10% for an AR-10; however, an AR-15 can have different values for the dimension D. When the bolt 550 is closed, it is in a position so that the hammer can swing the full length for firing the rifle. But when the bolt 550 is opened, the hammer pushing ridge 490 holds the hammer so that it cannot strike the firing pin so that the rifle cannot fire. The hammer clearance D is dimensioned so that once the rifle has fired, you can still draw the bolt 550 back to get the hammer to cock again. The hammer clearance for dimension D allows the hammer to be able to sit on the hammer pushing ridge 490 as you open your bolt 550 and draw it back. When the hammer is on the hammer pushing ridge 490, the gun cannot go off. The only way the hammer can go forward is if the bolt 550 is closed.

The end ramp 486 and end ridge 484 make sure that when the bolt 550 is not fully seated, the gun will not fire. While the hammer may be pulled forward, it is at an angle that does not hit the firing pin. When pushing the bolt 550 forward you can get to where the hammer is between the hammer pushing ridge 490 and the end ramp 486, you can pull the trigger and the hammer will go off, but it can't hit the firing pin because it's on the wrong angle. So the gun still can't go off. Even if you close the bolt 550 all the way with the hammer forward, the gun is not going to go off. The bolt 550 has to be rotated and seated so that the bolt handle is seated in the bolt rest in order for the gun to fire. As such, the bolt 550 provides safety mechanisms so that the gun does not fire until the bolt is set with the bolt handle in the bolt rest.

Figure 8A:
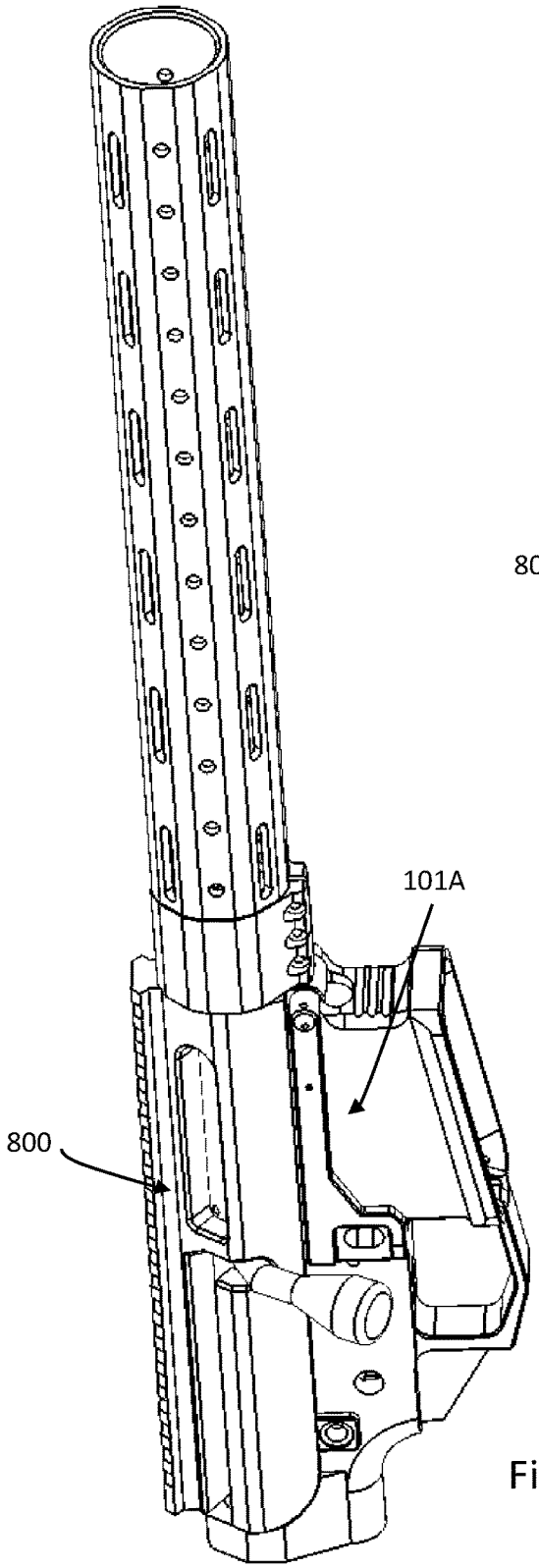
FIGS. 8A and 8B illustrate an embodiment of a bolt action upper receiver assembly coupled with a standard AR lower receiver assembly.
Figure 8B:
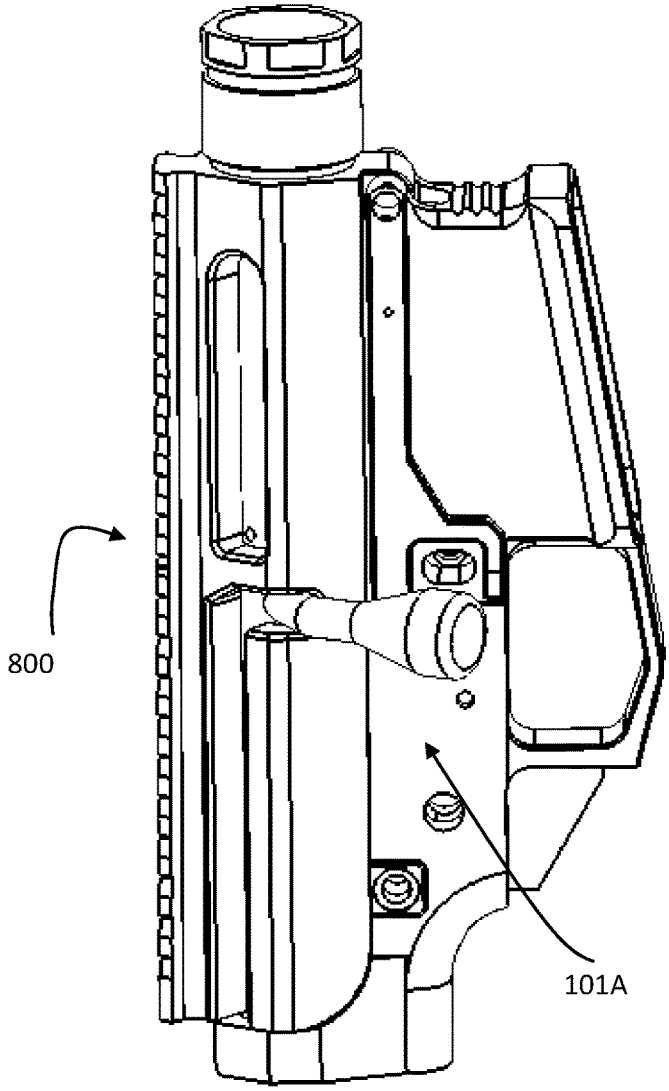
Figure 8C:
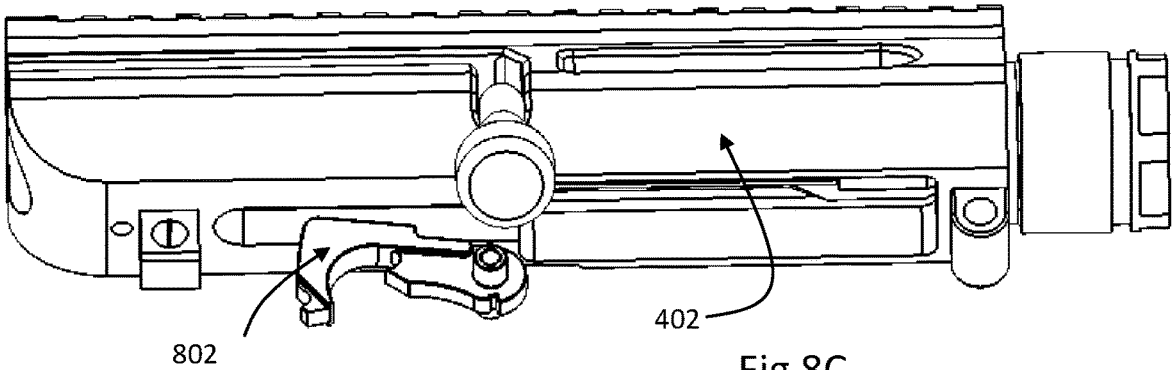
FIGS. 8C-8F show the bolt action upper receiver having the bolt in sequentially rotated views.
Figure 8D:
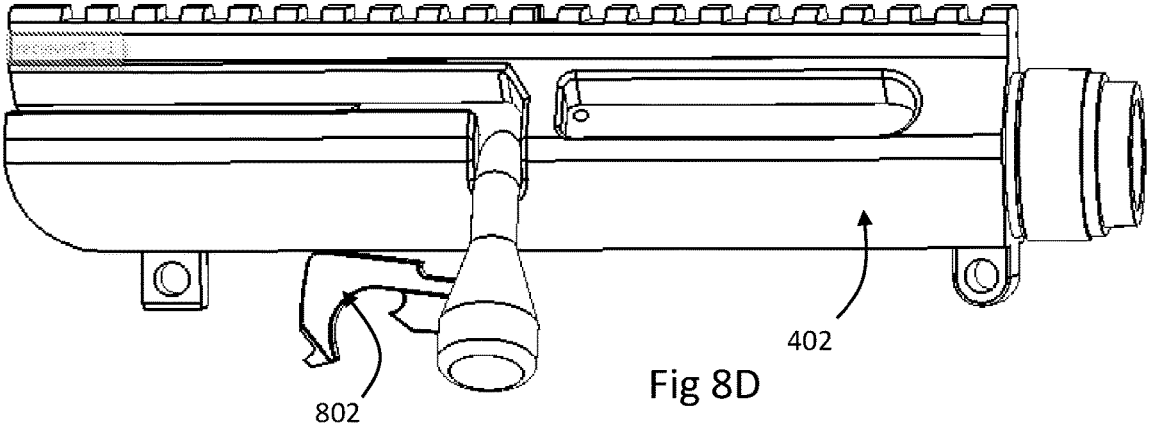
Figure 8E:
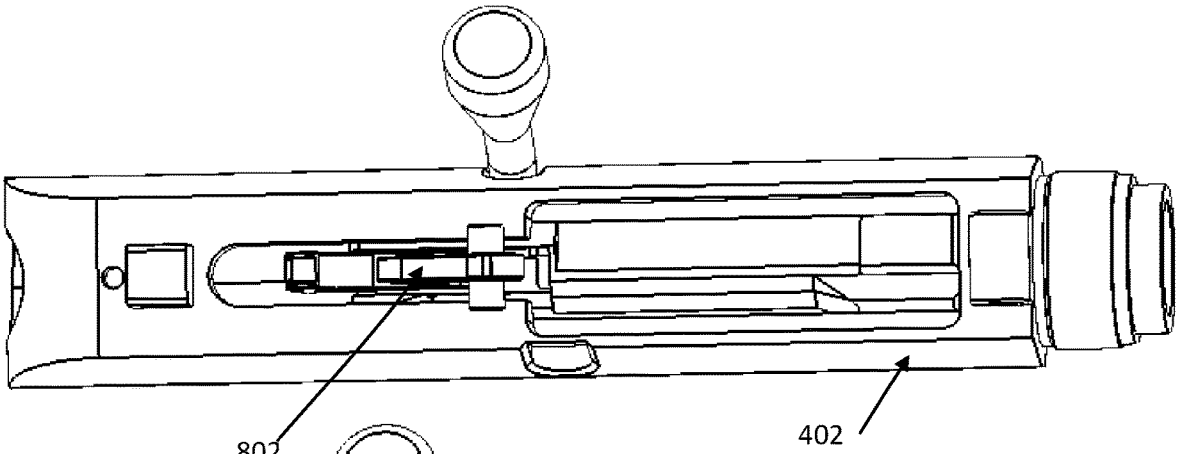
Figure 8F:
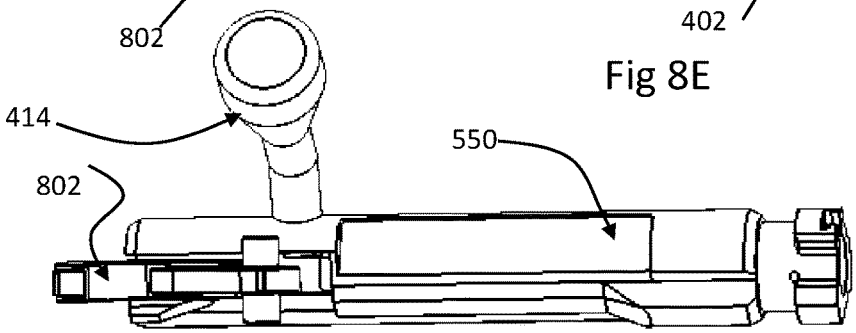

FIGS. 8A-8F show portions of the bolt action upper assembly 800 mounted to the standard lower assembly 101A, with and without the barrel guard. These figures show the arrangement of the elements as described herein. From FIG. 8A to FIG. 8F, various components are removed so that the arrangement of the outer components can be viewed relative to the inner components. For example, 8C shows the relationship of the hammer assembly 802 relative to the upper assembly 800 with respect to the receiver 402. FIG. 8D shows a rotation from the view of FIG. 8C. FIG. 8E shows a rotation from the view of 8D. FIG. 8F shows the relationship of the hammer assembly 802 with the bolt 550.

In one embodiment, the present invention relates to a bolt action AR upper assembly as shown in the figures. The bolt action AR upper assembly can include a bolt action AR upper receiver as shown in one of the figures. The bolt action AR upper assembly can include a bolt of one of the figures in the AR upper receiver.

In one embodiment, the invention can include a bolt action AR upper receiver as shown in the figures.

In one embodiment, the invention can include a bolt for a bolt action AR upper receiver as shown in the figures.

In one embodiment, a bolt action AR upper assembly as shown in the figures is configured to be compatible with an AR DPMS LR-308 pattern or Armalite AR-10 pattern.

In one embodiment, a bolt action AR upper assembly is configured to be connectable with an AR lower assembly via two connection points.

In one embodiment, the bolt action AR upper assembly is configured to be connectable with an AR-10 lower assembly.

In one embodiment, the bolt action AR upper assembly is configured to be connectable with an AR-15 lower assembly.

In one embodiment, a bolt action AR upper assembly is configured to be connectable with an AR lower assembly through a pivot pin system and a takedown pin system.

In one embodiment, a bolt action AR upper assembly or upper receiver can have an upper pivot pin receiver hole that couples with a lower pivot pin receiver hole of an AR lower assembly or lower receiver via a pivot pin.

In one embodiment, a bolt action AR upper assembly or upper receiver can have an upper takedown pin receiver hole that couples with a lower take down pin receiver hole of an AR lower assembly or lower receiver via a takedown pin.

In one embodiment, a bolt action AR upper assembly or upper receiver can have: an upper pivot pin receiver hole that couples with a lower pivot pin receiver hole of an AR lower assembly or lower receiver via a pivot pin; and an upper pivot pin receiver hole that couples with a lower pivot pin receiver hole of an AR lower assembly or lower receiver via a pivot pin.

In one embodiment, a bolt for a bolt action AR upper receiver that couples with an AR lower receiver is provided. The bolt can include a unitary body having: a bolt head at one end that includes bolt head lugs separated by bolt head reliefs; an end opposite of the bolt head that includes an end slot that widens into a hammer slot, wherein an end ridge borders the end slot on one side so that an end ramp transitions from the end ridge to the hammer slot; a bolt neck separates the bolt head from a bolt body that extends to the opposite end; and the bolt body includes a bullet pushing ridge extending from the bolt neck toward the opposite end and traverses the bolt body until reaching a bullet pushing slope that slopes to a hammer ridge, wherein the hammer ridge extends to the end slot and hammer slot. In one aspect, the bolt can include a magazine recess laterally adjacent to the bullet ridge. In one aspect, the bolt can include a bolt handle hole for receiving a bolt handle. In one aspect, the bolt can include a bolt handle in the bolt handle hole. In one aspect, the bolt can include a firing pin within a firing pin recess in the bolt, wherein the firing pin recess opens into the end slot.

In one embodiment, a bolt action upper receiver can be configured to couple with an AR lower receiver. The bolt action upper receiver can include a unitary body having: a barrel end having a threaded receiver; a bolt receiving end opposite of the threaded receiver; an internal chamber extending from the bolt receiving end to the barrel end that is adapted to slidably receive a bolt therein so that the bolt can slide during actuation; a bolt handle slot extending from the bolt receiving end to a bolt rest recess, wherein the bolt handle slot opens from the internal chamber, the bolt rest recess being orthogonal with the bolt handle slot; an extractor ramp at an end of the bolt handle slot opposite of the bolt receiving end, the extractor ramp transitioning from a side of the bolt handle slot to the bolt rest recess; an ejector port opening from the internal chamber and being positioned between the bolt handle slot and barrel end; a magazine slot on the bottom of the unitary body that opens from the internal chamber, where the magazine slot narrows to a hammer slot toward the bolt receiving end; an upper pivot pin receiver hole at the barrel end; and an upper takedown receiver hole at the bolt receiving end. In one aspect, the bolt action upper receiver can include a picatinny rail opposite of the magazine slot. In one aspect, the picatinny rail has a 20 MOA slope.

In one embodiment, a bolt action upper assembly is provided that couples to an AR lower assembly. The bolt action upper assembly can include: the bolt action upper receiver of one of the embodiments; and the bolt of one of the embodiments within the receiver lumen of the bolt action upper receiver.

In one embodiment, a bolt action AR rifle can include: a standard AR lower assembly having a lower pivot pin receiver hole and a lower takedown pin receiver hole; and a bolt action upper assembly of one of the embodiments coupled to the standard AR lower assembly by having a pivot pin in the upper and lower pivot pin receiver holes and a takedown pin in the upper and lower takedown pin receiver holes.

In one embodiment, a method of converting an AR rifle to a bolt action AR rifle can include: removing a standard AR upper assembly from a standard AR lower assembly; and mounting the bolt action upper assembly of one of the embodiments to the standard AR lower assembly by placing a pivot pin in the upper and lower pivot pin receiver holes and a takedown pin in the upper and lower takedown pin receiver holes.

In one embodiment, a method of assembling a bolt action AR rifle can include: mounting the bolt action upper assembly of one of the claims to the standard AR lower assembly by placing a pivot pin in the upper and lower pivot pin receiver holes and a takedown pin in the upper and lower takedown pin receiver holes.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A bolt configured for being included in a bolt action upper receiver of a bolt action upper receiver assembly, wherein the bolt action upper receiver assembly is configured to be coupled to a standard AR lower receiver assembly, the bolt comprising a unitary body having:

a bolt head having three bolt lugs extending outward relative to three bolt reliefs that are located between the bolt lugs, wherein one bolt lug includes an extractor slot extending radially from a bolt head recess all the way through the one bolt lug;

a bolt body being elongate and having:

a bullet pushing ridge extending from a bolt neck to a bolt end opposite of the bolt head, the bullet pushing ridge having a height and length relative to the bolt body;

a bullet pushing slope extending downward from the bullet pushing ridge toward the bolt end and terminating at a hammer pushing ridge;

the hammer pushing ridge extending from the bullet pushing slope to an end slot;

an end ramp across the end slot from the hammer pushing ridge, the end ramp extending upward; and an end ridge extending from a top of the end ramp; and a firing pin recess at the bolt end extending toward the bolt head, wherein the firing pin recess includes an opening from the bolt end around the end ramp and end ridge so as to be open with the end slot, wherein the bolt neck is connecting the bolt head with the bolt body, the bolt neck being thinner than the bolt body.

2. The bolt of claim 1, wherein the bullet pushing ridge, bullet pushing slope, hammer pushing ridge, end slot, end ramp and end ridge are longitudinally aligned with one of the bolt lugs.

3. The bolt of claim 2, the unitary body having a first body portion of the bolt body extending from the bolt neck toward the bolt end and terminating at a magazine recess that has a shape commensurate with a magazine with a second body portion extending from the magazine recess to the bolt end.

4. The bolt of claim 3, wherein the first body portion, the magazine recess and the second body portion are longitudinally aligned.

5. The bolt of claim 4, wherein the first body portion, the magazine recess and the second body portion are longitudinally aligned with the one bolt lug that has the extractor slot, and wherein the second body portion is separated from the end ridge by the firing pin recess.

6. The bolt of claim 5, the unitary body having a bolt handle recess in the second body portion offset from the magazine recess, the bolt handle recess extending into the firing pin recess.

7. The bolt of claim 6, wherein the first body portion and the second body portion are portions of a cylindrical portion of the unitary body, which the cylindrical portion extends from a first side of a base of the bullet pushing ridge and first side of a base of the end ridge around to a second side of the base of the bullet pushing ridge and second side of the base of the end ridge.

8. The bolt of claim 7, wherein the cylindrical portion includes a roll pin hole and a nut relief.

9. The bolt of claim 8, wherein the hammer pushing ridge has a higher elevation than the end ridge.

10. A bolt action upper receiver configured to be coupled with a standard AR lower receiver, the bolt action upper receiver comprising a unitary receiver body having a receiver lumen, the unitary receiver body having:

a top;

a proximal end having a bolt opening;

a distal end having a barrel opening surrounded by a threaded receiver with a dowel pin receiver in a distal end of the threaded receiver, the dowel pin receiver being axially oriented;

a bottom comprising:

a magazine slot open to and longitudinally aligned with a hammer slot, the hammer slot being narrower than the magazine slot;

a takedown pin receiver hole at a proximal end, the takedown pin receiver hole being orthogonal with the magazine slot and hammer slot; and a pivot pin receiver hole at a distal end, the pivot pin receiver hole being orthogonal with the magazine slot and hammer slot, the pivot pin receiver hole being parallel with the takedown pin receiver hole;

a first side having:

a bolt handle slot extending from the bolt opening and exposing a portion of the receiver lumen;

a bolt rest slot extending from the bolt handle slot; and an ejection port between the bolt handle slot and distal end; and a second side having a magazine release receiver recess.

11. The bolt action upper receiver of claim 10, comprising an extractor ramp that defines an end of the bolt handle slot that intersects with the bolt rest slot.

12. The bolt action upper receiver of claim 11, comprising a picatinny rail on the top.

13. The bolt action upper receiver of claim 12, the bottom comprising a pivot pin body having the pivot pin receiver hole and a takedown pin body having the takedown pin receiver hole.

14. A bolt action upper receiver assembly comprising:

a bolt action upper receiver configured to be coupled with a standard AR lower receiver, the bolt action upper receiver comprising a unitary receiver body having a receiver lumen, the unitary receiver body having:

a top;

a proximal end having a bolt opening;

a distal end having a barrel opening surrounded by a threaded receiver with a dowel pin receiver in a distal end of the threaded receiver, the dowel pin receiver being axially oriented;

a bottom comprising:

a magazine slot open to and longitudinally aligned with a hammer slot, the hammer slot being narrower than the magazine slot;

a takedown pin receiver hole at a proximal end, the takedown pin receiver hole being orthogonal with the magazine slot and hammer slot; and a pivot pin receiver hole at a distal end, the pivot pin receiver hole being orthogonal with the magazine slot and hammer slot, the pivot pin receiver hole being parallel with the takedown pin receiver hole;

a first side having:

a bolt handle slot extending from the bolt opening and exposing a portion of the receiver lumen;

a bolt rest slot extending from the bolt handle slot; and an ejection port between the bolt handle slot and distal end;

a second side having a magazine release receiver recess; and a bolt slidably located in the receiver lumen, the bolt comprising a unitary body having:

a bolt head having three bolt lugs extending outward relative to three bolt reliefs that are located between the bolt lugs, wherein one bolt lug includes an extractor slot extending radially from a bolt head recess all the way through the one bolt lug;

a bolt body being elongate and having:

a bullet pushing ridge extending from a bolt neck to a bolt end opposite of the bolt head, the bullet pushing ridge having a height and length relative to the bolt body;

a bullet pushing slope extending downward from the bullet pushing ridge toward the bolt end and terminating at a hammer pushing ridge;

the hammer pushing ridge extending from the bullet pushing slope to an end slot;

an end ramp across the end slot from the hammer pushing ridge, the end ramp extending upward; and an end ridge extending from a top of the end ramp; and a firing pin recess at the bolt end extending toward the bolt head, wherein the firing pin recess includes an opening from the bolt end around the end ramp and end ridge so as to be open with the end slot, wherein the bolt neck is connecting the bolt head with the bolt body, the bolt neck being thinner than the bolt body.

15. The bolt action upper receiver assembly of claim 14, wherein the bullet pushing ridge, the bullet pushing slope, the hammer pushing ridge, the end slot, the end ramp and the end ridge are longitudinally aligned with one of the bolt lugs, and which are oriented toward the bottom of the bolt action upper receiver in a firing orientation.

16. The bolt action upper receiver assembly of claim 15, the unitary body having a first body portion of the bolt body extending from the bolt neck toward the bolt end and terminating at a magazine recess that has a shape commensurate with a magazine with a second body portion extending from the magazine recess to the bolt end, wherein the first body portion, the magazine recess and the second body portion are longitudinally aligned, wherein the magazine recess is oriented toward the bottom of the bolt action upper receiver in a loading orientation.

17. The bolt action upper receiver assembly of claim 16, the unitary body having a bolt handle recess in the second body portion offset from the magazine recess, the bolt handle recess extending into the firing pin recess, a bolt handle located in the bolt handle recess, the bolt handle:

extending out of the bolt handle slot during the loading orientation; and extending out of the bolt rest slot during the firing orientation.

18. The bolt action upper receiver assembly of claim 17, the bolt action upper receiver comprising an extractor ramp that defines an end of the bolt handle slot that intersects with the bolt rest slot.

19. The bolt action upper receiver assembly of claim 18, the bolt action upper receiver comprising a picatinny rail on the top.

20. A method of forming a bolt action AR rifle, the method comprising:

providing the bolt action upper receiver assembly of claim 14;

providing a standard AR lower receiver assembly having a pivot pin and takedown pin;

inserting the pivot pin into the pivot pin receiver hole;

pivoting the bolt action upper receiver assembly at the pivot pin until the takedown pin is aligned with the takedown pin receiver hole; and inserting the takedown pin into the takedown pin receiver hole.

* * * * *